US008950747B2

(12) United States Patent
Kikuchi et al.

(10) Patent No.: US 8,950,747 B2
(45) Date of Patent: Feb. 10, 2015

(54) RECORDING PAPER CONVEYING DEVICE, DOCUMENT FEEDING DEVICE AND IMAGE FORMING APPARATUS INCLUDING THESE DEVICES

(71) Applicant: Sharp Kabushiki Kaisha, Osaka-shi, Osaka (JP)

(72) Inventors: Yoshiteru Kikuchi, Osaka (JP); Kohji Aoki, Osaka (JP); Shinichi Azumi, Osaka (JP); Norichika Katsura, Osaka (JP); Yoshinori Shiraishi, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 0 days.

(21) Appl. No.: 13/658,931

(22) Filed: Oct. 24, 2012

(65) Prior Publication Data

US 2013/0099441 A1 Apr. 25, 2013

(30) Foreign Application Priority Data

Oct. 24, 2011 (JP) ..... 2011-233013
Dec. 16, 2011 (JP) ..... 2011-275806

(51) Int. Cl.
*B65H 9/04* (2006.01)
*B65H 5/38* (2006.01)
*G03G 15/00* (2006.01)
(Continued)

(52) U.S. Cl.
CPC ..... *B65H 5/38* (2013.01); *G03G 15/6561* (2013.01); *B65H 7/02* (2013.01); *B65H 9/006* (2013.01); *B65H 2404/611* (2013.01); *B65H 2513/108* (2013.01); *B65H 2513/50* (2013.01); *B65H 2701/1311* (2013.01); *B65H 2701/1313* (2013.01)
USPC ..... 271/242

(58) Field of Classification Search
USPC ..... 271/242, 243, 245, 246, 247
See application file for complete search history.

(56) References Cited

U.S. PATENT DOCUMENTS 5,222,728 A * 6/1993 Takahashi ..... 271/242
5,967,506 A * 10/1999 Miki et al. ..... 271/10.13
(Continued)

FOREIGN PATENT DOCUMENTS

JP 05-270693 10/1993
JP 11-255380 9/1999
(Continued)

OTHER PUBLICATIONS

Machine translation of Detailed Description section of JP 11-255380.*

*Primary Examiner* — Thomas Morrison
(74) *Attorney, Agent, or Firm* — Nixon & Vanderhye P.C.

(57) ABSTRACT

A recording paper conveying device includes a registration roller pair and a conveyor roller pair adjacent to the registration roller pair. By rotating the conveyor roller pair, a sheet of recording paper is fed until leading edge of the sheet abuts the registration roller pair in stationary state so that the sheet is deflected by a prescribed amount. Then, conveyor roller pair is rotated at the constant velocity, and while the sheet is kept deflected, rotation of the registration roller pair is started, to start feeding of the sheet by the registration roller pair. While the registration roller pair is kept rotating, rotation of the conveyor roller pair is suspended, and then, the conveyor roller pair is returned to the state of rotation before suspension. Thus, unnecessary deflection of the sheet just in front of the registration roller pair can be prevented.

16 Claims, 16 Drawing Sheets

(51) Int. Cl.
*B65H 7/02* (2006.01)
*B65H 9/00* (2006.01)

(56) References Cited

U.S. PATENT DOCUMENTS 6,092,803 A * 7/2000 Munenaka ..... 271/242
7,328,898 B2 2/2008 Yasui
2010/0109229 A1 5/2010 Iwakawa
2012/0153566 A1 * 6/2012 Ito et al. ..... 271/265.01

FOREIGN PATENT DOCUMENTS

JP 2006-248677 9/2006
JP 2009-282415 12/2009
JP 2010-083649 4/2010
JP 2010-111472 5/2010

* cited by examiner

RECORDING PAPER CONVEYING DEVICE, DOCUMENT FEEDING DEVICE AND IMAGE FORMING APPARATUS INCLUDING THESE DEVICES

CROSS-REFERENCE TO RELATED APPLICATIONS

This nonprovisional application claims priority under 35 U.S.C. §119(a) on Patent Application Nos. 2011-233013 and 2011-275806 filed in Japan on Oct. 24, 2011 and Dec. 16, 2011, respectively, the entire contents of which are hereby incorporated by reference.

BACKGROUND OF THE INVENTION

1. Field of the Invention

The present invention relates to an image forming apparatus and, more specifically, to a recording paper conveying device, a document feeding device and an image forming apparatus provided with these devices, preventing unnecessary deflection of recording paper in front of a registration roller pair and thereby enabling reduction in size of products.

2. Description of the Background Art

In an image forming apparatus such as a copying machine, a sheet of recording paper is drawn out from a paper feed tray and fed to an image forming unit, and an image is formed (printed) on a surface of the recording paper. By way of example, if electrophotography is utilized, a toner image carried on a photoreceptor drum or on a transfer body is transferred to a fed sheet of recording paper to obtain an image. The sheet of recording paper is drawn out from the paper feed tray by means of a roller, pinched by opposing rollers arranged along a paper feed path, and fed by the rotation of rollers. When a sheet of recording paper is drawn out from the paper feed tray, leading edge of the sheet may possibly be drawn out not in an orientation perpendicular to the drawing direction, but rotated to some extent. During feeding of the recording paper, it is also possible that the sheet is conveyed with its leading edge not kept perpendicular to the feeding direction. If the sheet of recording paper is fed askew to the transfer unit, an image will be formed askew with respect to the longitudinal or lateral side of the recording paper.

Similar problem may occur when a document is fed to a scanning position using an automatic document feeder (ADF) in an image forming apparatus. If the document is fed askew, the document will be scanned askew.

Therefore, conventionally, skew correction of recording paper is done immediately preceding a registration roller pair (upstream side in the paper feed direction) for supplying the recording paper to the transfer unit. Specifically, a conveyor roller pair (in the following, also referred to as a pre-registration roller pair) arranged immediately preceding the registration roller pair feeds a sheet of recording paper to the registration roller pair of which rotation is suspended, leading edge of the sheet is brought into contact with or abuts the registration roller pair so that the sheet is deflected, and then rotation of the registration roller pair is started, to convey the sheet of recording paper. By way of example, the velocities of registration roller pair and pre-registration roller pair are controlled as shown in FIG. 1. The upper part of the graph shows time-change of the velocity Vr of registration roller pair, and the lower part of the graph shows time-change of the velocity Vp of pre-registration roller pair. By the pre-registration roller pair, the sheet of recording paper is fed to just in front of the registration roller pair, and then, the pre-registration roller pair is temporarily suspended (time t0). By the time the leading edge of the sheet reaches a prescribed position (just in front of the registration roller pair) and the pre-registration roller pair stops rotation, rotation of the registration roller pair has been suspended. At time t1, the pre-registration roller pair starts rotation (while the registration roller pair is stopped), at time t2, the leading edge of the sheet abuts the registration roller pair, and by the time t3, the sheet of recording paper is deflected by a prescribed amount. Thereafter, rotation of the registration roller pair is started, so that the sheet of recording paper is conveyed. In this manner, even if the sheet of recording paper has been fed askew toward the registration roller pair, the sheet of recording paper can be supplied to the transfer unit with the skew corrected. It is noted here that in the time period between t3 to t6, the pre-registration roller pair rotates at a constant velocity of Vc, while the velocity of registration roller Vr is lower than the velocity Vc of pre-registration roller pair. Consequently, the sheet of recording paper is much deflected. The length that corresponds to the area of hatched portion S0 in FIG. 1 represents excess deflection.

As a solution to this problem, Japanese Patent Laying-Open No. 2010-111472 (hereinafter referred to as '472 Reference) discloses a technique of deflecting a sheet (of recording paper) by a prescribed amount by the rotation of pre-registration roller pair, and thereafter accelerating the registration roller pair and the pre-registration roller pair simultaneously and at the same rate of acceleration to attain a constant velocity, as shown in FIG. 2. This prevents excess deflection of the sheet.

In '472 Reference, however, the velocity of rotation of pre-registration roller pair to cause the prescribed amount of deflection is a low velocity (100 mm/s) that corresponds to a self-start frequency at which a stepping motor driving the pre-registration roller pair can start rotation, and the pre-registration roller pair is once stopped. Therefore, it takes time to form an image on the sheet of recording paper, and performance of the image forming apparatus cannot be much enhanced. This poses a significant problem in a high-speed apparatus.

SUMMARY OF THE INVENTION

In view of the problems described above, it is desirable to provide a recording paper conveying device, a document feeding device and an image forming apparatus provided with these devices, all reduced in size, capable of preventing unnecessary deflection of recording paper or document immediately in front of the registration roller pair, and thereby reducing the space for holding the recording paper or document deflected in an appropriate shape, while not compromising their performances.

According to a first aspect, the present invention provides a recording paper conveying device, including a registration roller pair and a conveyor roller pair arranged adjacent to the registration roller pair on an upstream side of a recording paper feeding direction. The recording paper conveying device is for conveying a sheet of recording paper by rotating the conveyor roller pair, to have a leading edge of the sheet of recording paper abut the registration roller pair in a stationary state, and thereby causing the sheet of recording paper to deflect by a prescribed amount. In the recording paper conveying device, the registration roller pair is rotated with the conveyor roller pair kept rotating and the sheet of recording paper kept deflected, so as to start feeding of the sheet of recording paper by the registration roller pair, and while the registration roller pair is kept rotating, rotation of the conveyor roller pair is suspended for a prescribed time period and thereafter restarted, or decelerated for a prescribed time period and thereafter accelerated.

Preferably, rotation of the conveyor roller pair is suspended or decelerated while the registration roller pair is rotating with acceleration.

More preferably, in the recording paper conveying device, while the registration roller pair is rotating, rotation of the conveyor roller pair is suspended for the prescribed time period and thereafter restarted to resume a state of rotation before suspension, or decelerated for the prescribed time period and thereafter accelerated to resume a state of rotation before deceleration.

More preferably, velocity of rotation of the conveyor roller pair when the registration roller pair is rotated with the sheet of recording paper kept deflected is a constant velocity; the state before suspension or the state before deceleration is a state in which the velocity of rotation is the constant velocity; and the registration roller pair rotated with the sheet of recording paper kept deflected is accelerated until velocity of rotation attains to the constant velocity.

More preferably, the recording paper conveying device further includes: a first driving device for rotating the registration roller pair; and a second driving device different from the first driving device, for rotating the conveyor roller pair.

More preferably, the first and second driving devices are stepping motors. The recording paper conveying device further includes a driver unit for supplying pulse signals of a prescribed sequence for controlling the stepping motor to each of the first and second driving devices. The driver unit supplies, to the second driving device, pulse signals of a sequence causing rotation of the second driving device to be suspended or to be decelerated for a prescribed time period and thereafter to resume the state of rotation before suspension or deceleration, while supplying, to the first driving device, pulse signals of a sequence causing the first driving device to rotate.

Preferably, the recording paper conveying device further includes: a driving device; a first clutch for connecting the registration roller pair to the driving device; and a second clutch for connecting the conveyor roller pair to the driving device; and the driving device rotates the registration roller pair through the first clutch, and rotates the conveyor roller pair through the second clutch.

According to a second aspect, the present invention provides a document feeding device, including a registration roller pair and a conveyor roller arranged adjacent to the registration roller pair on an upstream side of a document feeding direction. The document feeding device is for feeding a document by rotating the conveyor roller, to have a leading edge of the document abut the registration roller pair in a stationary state, and thereby causing the document to deflect by a prescribed amount. In the document feeding device, the registration roller pair is rotated with the conveyor roller kept rotating and the document kept deflected, so as to start feeding of the document by the registration roller pair; and while the registration roller pair is kept rotating, rotation of the conveyor roller is suspended or decelerated for a prescribed time period and thereafter the conveyor roller is returned to the state of rotation before suspension or deceleration.

According to a third aspect, the present invention provides an image forming apparatus including at least one of the recording paper conveying device in accordance with the first aspect and the document feeding device in accordance with the second aspect.

According to a fourth aspect, the present invention provides a recording paper conveying device, including a registration roller pair and a conveyor roller pair arranged adjacent to the registration roller pair on an upstream side of a recording paper feeding direction. The recording paper conveying device is for conveying a sheet of recording paper by rotating the conveyor roller pair, to have a leading edge of the sheet of recording paper abut the registration roller pair in a stationary state, and thereby causing the sheet of recording paper to deflect by a prescribed amount. In the recording paper conveying device, the conveyor roller pair is rotated at a constant velocity to cause said deflection of the sheet of recording paper; the registration roller pair is rotated to start feeding of the sheet of recording paper by the registration roller pair, with the sheet of recording paper kept deflected and the conveyor roller pair kept rotating at the constant velocity; and when velocity of rotation of the registration roller pair reaches a prescribed velocity, rotation of the conveyor roller pair is further accelerated from the constant velocity.

Preferably, in the recording paper conveying device, the conveyor roller pair is rotated to feed the sheet of recording paper until a leading edge of the sheet of recording paper reaches a position near the registration roller pair in a stationary state, rotation of the conveyor roller pair is suspended at this time point, and thereafter the conveyor roller pair is rotated with acceleration to cause the deflection of the sheet of recording paper.

More preferably, in the recording paper conveying device, after starting feeding of the sheet of recording paper by the registration roller pair by rotating the registration roller pair, rotation of the registration roller pair is accelerated.

More preferably, in the recording paper conveying device, the conveyor roller pair in a stationary state is rotated with acceleration at a constant rate of acceleration and thereafter rotated at the constant velocity. The rate of acceleration for further accelerating rotation of the conveyor roller pair from the constant velocity and the rate of acceleration for accelerating rotation of the registration roller pair are the same as the constant rate of acceleration.

Preferably, the timing of further accelerating rotation of the conveyor roller pair from the constant velocity is when velocity of rotation of the registration roller pair becomes equal to the constant velocity.

More preferably, the recording paper conveying device further includes: a first driving device for rotating the registration roller pair; and a second driving device different from the first driving device, for rotating the conveyor roller pair.

More preferably, the first and second driving devices are stepping motors, and the recording paper conveying device further includes a driver unit for supplying pulse signals of a prescribed sequence for controlling the stepping motor to each of the first and second driving devices. The driver unit supplies pulse signals of a first sequence to cause the conveyor roller pair to rotate at the constant velocity to the first driving device to cause the deflection of the recording paper, supplies pulse signals of a second sequence to cause the registration roller pair to rotate to the second driving device, while the pulse signals of the first sequence are supplied to the first driving device, and when velocity of rotation of the registration roller pair reaches a prescribed velocity, supplies pulse signals of a third sequence to further accelerate rotation of the conveyor roller pair from the constant velocity, to the first driving device.

Preferably, the recording paper conveying device further includes: a driving device; a first clutch for connecting the registration roller pair to the driving device; and a second clutch for connecting the conveyor roller pair to the driving device. The driving device rotates the registration roller pair through the first clutch, and rotates the conveyor roller pair through the second clutch.

According to a fifth aspect, the present invention provides a document feeding device, including a registration roller pair and a conveyor roller arranged adjacent to the registration roller pair on an upstream side of a document feeding direction. The document feeding device is for feeding a document by rotating the conveyor roller, to have a leading edge of the document abut the registration roller pair in a stationary state, and thereby causing the document to deflect by a prescribed amount. In the document feeding device, the conveyor roller is rotated at a constant velocity to cause the deflection of the document; the registration roller pair is rotated to start feeding of the document by the registration roller pair, with the sheet kept deflected and the conveyor roller kept rotating at the constant velocity; and when velocity of rotation of the registration roller pair reaches a prescribed velocity, rotation of the conveyor roller is further accelerated from the constant velocity.

According to a sixth aspect, the present invention provides an image forming apparatus including at least one of the recording paper conveying device in accordance with the fourth aspect and the document feeding device in accordance with the fifth aspect.

By the present invention, it becomes possible to maintain an appropriate deflection, without causing unnecessary deflection of the sheet of recording paper exceeding the necessary amount for correcting any skew of the recording paper or document, immediately in front of the registration roller pair. Therefore, the space for holding the recording paper or document deflected appropriately without causing buckling between the registration roller pair and the pre-registration roller pair can be made smaller. As a result, the recording paper conveying device, the document feeding device and the image forming apparatus using these devices can be reduced in size.

Further, the present invention does not lower the performance of feeding the recording paper or document.

Further, by the present invention, it is possible to set the constant velocity of conveyor roller pair to a value close to the process velocity of image formation or a value not much slower than the process velocity. Therefore, a high-speed recording paper conveying device and the image forming apparatus using the same can be reduced in size.

Further, by the present invention, it is possible to set the constant velocity of conveyor roller pair to a value close to the process velocity of document scanning or a value not much slower than the process velocity. Therefore, a high-speed document feeding device and the image forming apparatus using the same can be reduced in size.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
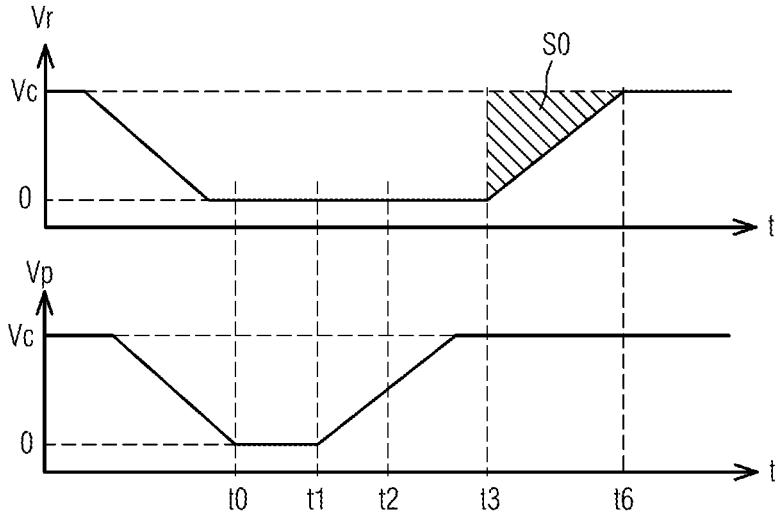
FIG.1 (Prior Art)
FIG. 1 is a timing chart showing control waveforms of conventional registration roller pair and pre-registration roller pair.
Figure 2:
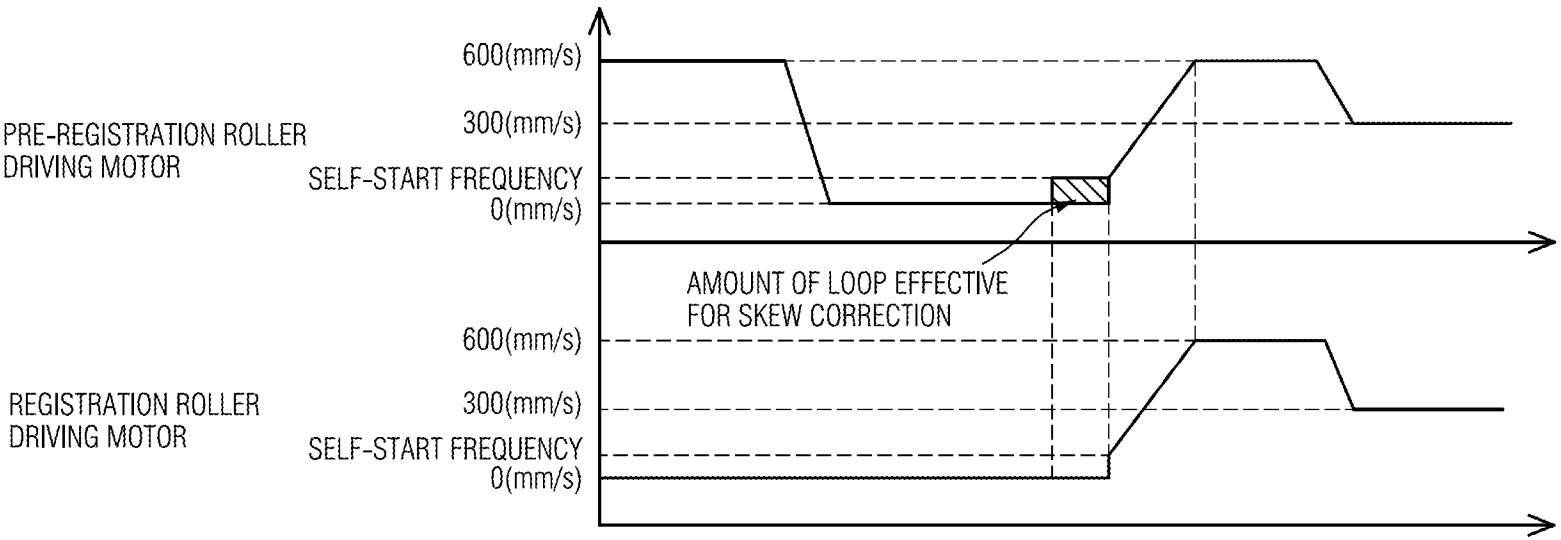
FIG.2 (Prior Art)
FIG. 2 is a timing chart showing control waveforms of conventional registration roller pair and pre-registration roller pair, different from FIG. 1.

In the following embodiments, the same components are denoted by the same reference characters. Their names and functions are also the same. Therefore, detailed description thereof will not be repeated.

First Embodiment

Figure 3:
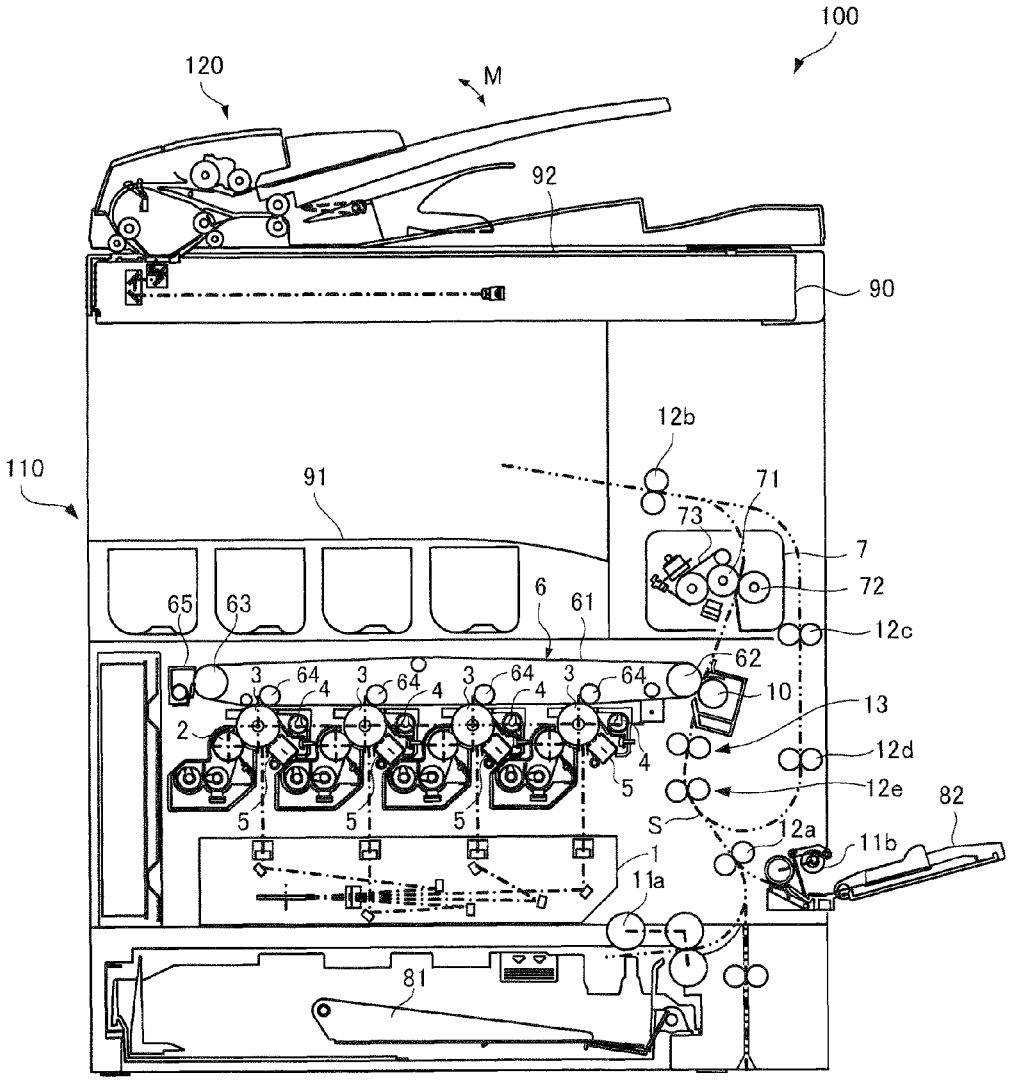
FIG. 3 is a cross-sectional view showing a configuration of an image forming apparatus in accordance with an embodiment of the present invention.

Referring to FIG. 3, an image forming apparatus 100 in accordance with the first embodiment of the present invention consists of an apparatus main body 110 and an automatic document feeder 120. Main body 110 includes an optical scanning device 1, a developer 2, a photoreceptor drum 3, a cleaner unit 4, a charger 5, an intermediate transfer belt unit 6, a fixing unit 7, a paper feed cassette 81, and a paper discharge tray 91.

At an upper portion of main body 110, image reading device 90 provided with a platen 92 of transparent glass for placing a document is arranged, and automatic document feeder 120 is attached above platen 92. Automatic document feeder 120 is formed to be rotatable in the direction of an arrow M, so that when opened, one can manually place the document on platen 92.

The image data handled in the present image forming apparatus 100 are color image data using colors of black (K), cyan (C), magenta (M) and yellow (Y), that is, image data separated to components of these four colors. Therefore, in order to form four different latent images of respective colors, four developers 2, four photoreceptor drums 3, four chargers 5 and four cleaner units 4 are provided.

Charger 5 is a device for uniformly charging the surface of photoreceptor drum 3 to a prescribed potential.

Optical scanning device 1 is a laser scanning unit (LSU) including a laser emitting unit and a reflection mirror.

Optical scanning device 1 exposes the charged photoreceptor drum 3 in accordance with the input image data, and thereby forms an electrostatic latent image in accordance with the image data on the surface. Developer 2 turns the electrostatic latent images formed on respective photoreceptor drums 3 to visible images with toners of four colors (YMCK), respectively. Cleaner unit 4 removes and recovers the toner left on the surface of each photoreceptor drum 3, after development and image transfer.

Intermediate transfer belt unit 6 arranged above photoreceptor drum 3 includes an intermediate transfer belt 61, an intermediate transfer belt driving roller 62, an intermediate transfer belt driven roller 63, an intermediate transfer roller 64 and an intermediate transfer belt cleaning unit 65.

Around intermediate transfer belt driving roller 62, intermediate transfer belt driven roller 63, and intermediate transfer roller 64, intermediate transfer belt 61 is wound and driven to rotate.

By successively transferring the toner images of respective colors formed on photoreceptor drums 3 onto intermediate transfer belt 61 to be superposed on the last, a color toner image (multi-color toner image) is formed on intermediate transfer belt 61.

Transfer of the toner image from photoreceptor drum 3 to intermediate transfer belt 61 is done by intermediate transfer roller 64 that is in contact with the back side of intermediate transfer belt 61. A high voltage transfer bias is applied to intermediate transfer roller 64, in order to transfer the toner image.

Information of the superposed images (density distribution of toner) on intermediate transfer belt 61 is transferred to a sheet of recording paper, as intermediate transfer belt 61 is rotated, by a transfer roller 10 arranged at the position of contact between the intermediate transfer belt 61 and the sheet of recording paper.

At this time, intermediate transfer belt 61 and transfer roller 10 are brought in to pressure-contact with a prescribed nip, and a voltage for transferring the toner to the sheet of recording paper is applied to transfer roller 10.

The toner left on intermediate transfer belt 61 are removed and recovered by intermediate transfer belt cleaning unit 65.

Paper feed cassette 81 is a tray for storing sheets of recording paper to be used for image formation, and provided below optical scanning device 1 in main body 110. Sheets of recording paper may also be placed on a manual feed cassette 82. A paper discharge tray 91 provided on main body 110 is for collecting the printed sheets of paper in face-down manner, that is, with the printed surface facing downward.

In main body 110, a paper feeding path S is formed in a substantially vertical direction, for feeding sheets of recording paper in paper feed cassette 81 or manual feed cassette 82 to paper discharge tray 91 through transfer roller 10 and fixing unit 7.

Conveyor roller pairs 12*a* to 12*e* are small rollers for promoting and assisting feeding of the recording paper, and a plurality of conveyor roller pairs are provided along paper feeding path S.

Registration roller pair 13 temporarily holds the sheet of recording paper fed along paper feeding path S. Then registration roller pair 13 feeds the sheet of recording paper to transfer roller 10 at such timing when the leading edge of toner image on photoreceptor drum 3 is aligned with the leading edge of the sheet of recording paper.

Fixing unit 7 includes a heat roller 71 and a pressure roller 72. Heat roller 71 and pressure roller 72 rotate, with the sheet of recording paper pinched therebetween. Heat roller 71 presses with heat, together with pressure roller 72, the toner to the sheet of recording paper, and thus, it has a function of melting, mixing and causing pressure-contact of multi-color toner image that has been transferred to the sheet of recording paper and thereby heat-fixing the image on the sheet of recording paper. Further, an external heating belt 73 for heating heat roller 71 from outside is provided in fixing unit 7.

The path for feeding the sheet of recording paper will be specifically described. In order to feed sheets of paper from these paper cassettes 81 and 82, pick-up rollers 11*a* and 11*b* are arranged, respectively, to guide the sheets of recording paper one by one to paper feeding path S.

A sheet of recording paper coming from paper feed cassette 81 or 82 is conveyed to registration roller pair 13 by conveyor roller pairs 12*a* and 12*e* along paper feeding path S, fed to transfer roller 10 at the timing when the leading edge of the sheet and the leading edge of image information are aligned, and thus, image information is written on the sheet of recording paper. Thereafter, not-yet fixed toner on the sheet of recording paper is melted and fixed as the sheet passes through fixing unit 7, and through conveyor roller pair 12*b* arranged at the end of paper feeding path S, the sheet is discharged to discharge tray 91.

If double-sided printing is requested, when the rear end of the sheet that has passed the fixing unit 7 is held by the conveyor roller pair 12*b* at the end of the feeding path, the conveyor roller pair 12*b* rotates in reverse direction. Thus, the sheet of recording paper is fed to conveyor roller pairs 12*c* and 12*d*. Thereafter, the sheet of recording paper is fed to registration roller pair 13, printing is done on the back side of the sheet in the same manner as described above, and then the sheet is discharged to paper discharge tray 91.

In the following, skew correction of the sheet of recording paper in image forming apparatus 100, that is, the process for deflecting the sheet of recording paper just in front of registration roller pair 13 will be described.

Figure 4:
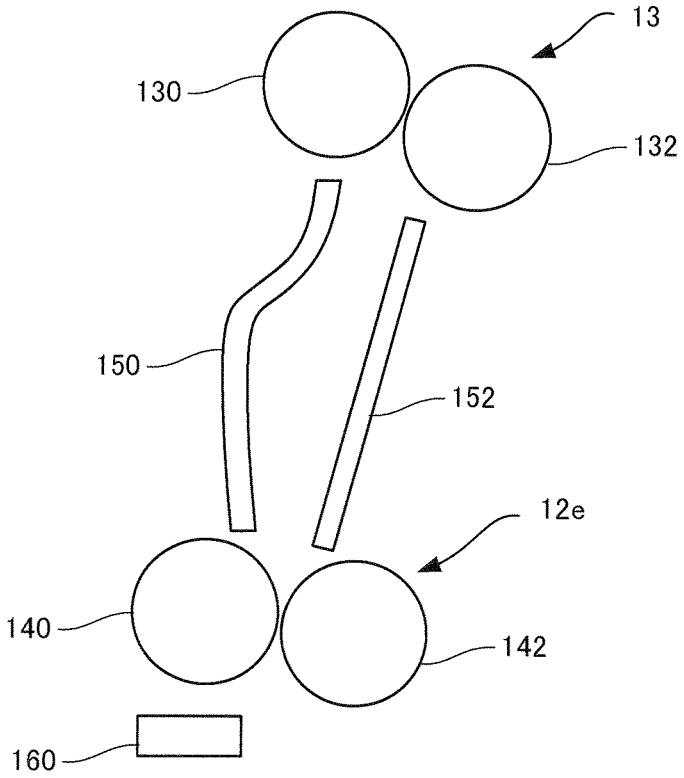
FIG. 4 is a schematic diagram showing a structure near the registration roller pair and the preregistration roller pair in the image forming apparatus shown in FIG. 3.

Referring to FIG. 4, registration roller pair 13 includes a first driving roller 130 and a first driven roller 132. The first driving roller 130 and the first driven roller 132 are in pressure contact with each other at a prescribed nip, and a sheet of recording paper can be pinched and fed therebetween. The first driven roller 132 is driven in passive manner, when the first driving roller 130 is driven by a motor, which will be described later. Conveyor roller pair 12*e* (pre-registration roller pair) includes a second driving roller 140 and a second driven roller 142. The second driving roller 140 and the second driven roller 142 are in pressure contact with each other at a prescribed nip, and a sheet of recording paper can be pinched and fed therebetween. The second driven roller 142 is driven in passive manner, when the second driving roller 140 is driven by a motor.

Between registration roller pair 13 and pre-registration roller pair 12*e*, a first conveyor guide 150 and a second conveyor guide 152 are arranged. The first and second conveyor guides 150 and 152 are arranged spaced by a prescribed distance. The first conveyor guide 150 has a recessed portion, to increase the distance to the second conveyor guide 152. This prevents significant bending and buckling of the sheet of recording paper, and thus, the sheet of recording paper can be moderately deflected in one direction.

Near the pre-registration roller pair 12*e* (on the upstream side of paper feeding path S), a sensor 160 is arranged. Sensor 160 detects the leading edge of the sheet of recording paper fed along paper feeding path S. Any sensor 160 may be used, as long as it can detect the leading edge of conveyed sheet of recording paper. By way of example, sensor 160 may be a photo sensor including an actuator. It is also possible to place a light emitting device and a light receiving device on opposite sides of the paper feeding path S, to form sensor 160.

Figure 5:
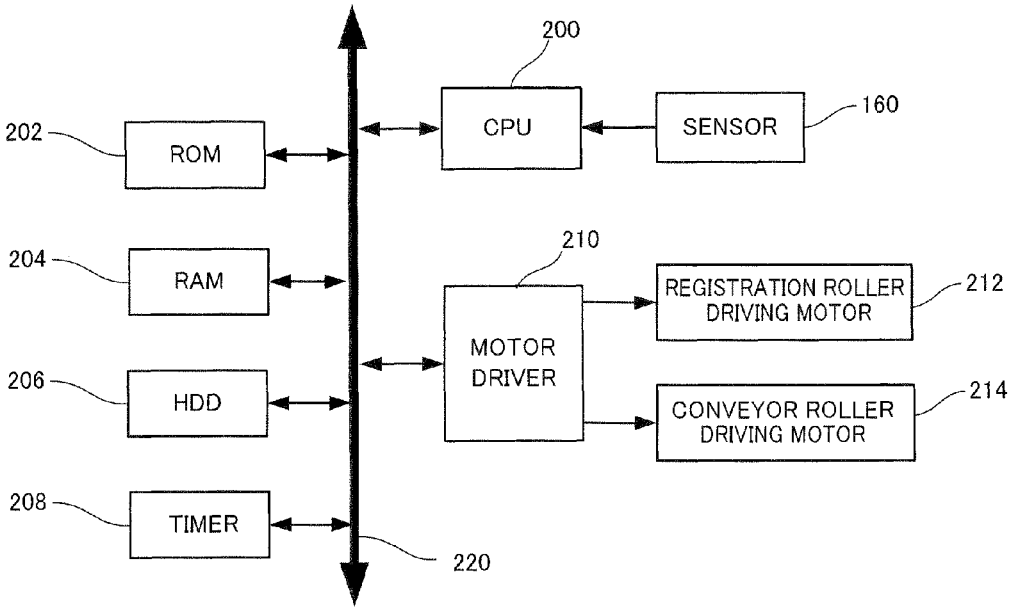
FIG. 5 is a block diagram showing a mechanism for controlling driving of the registration roller pair and the pre-registration roller pair shown in FIG. 4.

Referring to FIG. 5, a mechanism for driving registration roller pair 13 and conveyor roller pair 12*e* includes: a control unit (hereinafter referred to as CPU (Central Processing Unit) 200; an ROM (Read Only Memory) 202; an RAM (Random Access Memory) 204; an HDD (Hard Disk Drive) 206; a timer 208; a motor driver 210; a registration roller driving motor 212; and a conveyor roller driving motor 214. ROM 202 stores programs and the like. RAM 204 is a volatile storage device. HDD 206 is a non-volatile storage device that retains data even when power is shut off. Registration roller driving motor 212 is a motor for driving the first driving roller 130. Conveyor roller driving motor 214 is a motor for driving the second driving roller 140.

Registration roller driving motor 212 and conveyor roller driving motor 214 are stepping motors. Rotation rate of a stepping motor is determined by the frequency of input pulses. The stepping motor receives pulse signals of a prescribed sequence from motor driver 210, and changes the state of driving (state of rotation) accordingly. To motor driver 210, a prescribed control signal (a signal indicating the timing of activating and suspending registration roller driving motor 212 and conveyor roller driving motor 214) is transmitted from CPU 200. In response, motor driver 210 reads pulse signals of a sequence corresponding to the control signal (instruction) from CPU 200 from ROM 202, and outputs the signals to registration roller driving motor 212 and conveyor roller driving motor 214. Motor driver 210 may be realized as a general purpose or dedicated electronic circuit and a program for operating the circuit. Alternatively, motor driver 210 may be implemented as a dedicated electronic circuit including a semiconductor device such as an ASIC.

Figure 6:
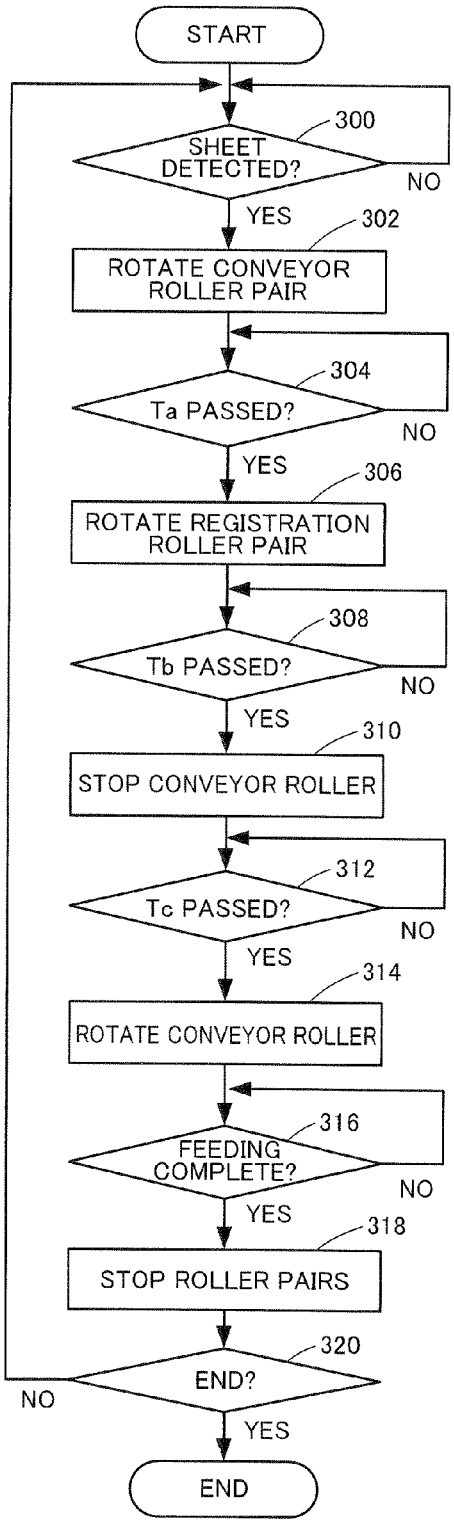
FIG. 6 is a flowchart representing a control structure of a program executing skew correction in the image forming apparatus in accordance with a first embodiment of the present invention.

Referring to FIG. 6, the program for executing skew correction in image forming apparatus 100 in accordance with the first embodiment will be described. In the first state, registration roller pair 13 and pre-registration roller pair 12*e* are in stationary state. ROM 202 or HDD 206 stores time periods Ta to Tc, which will be described later.

At step 300, CPU 200 determines whether or not sensor 160 has detected a sheet of recording paper. Specifically, CPU 200 determines whether or not the signal from sensor 160 is at a level that is output when a sheet of recording paper is detected. By way of example, the output signal from sensor 160 is at the low level when no sheet is detected, and it attains to the high level when a sheet of recoding paper is detected. If it is determined that a sheet of recording paper is detected, the control proceeds to step 302. Otherwise, step 300 is repeated.

At step 302, CPU 200 transmits a control signal for rotating the conveyor roller pair (pre-registration roller pair) 12*e* to motor driver 210. In response, motor driver 210 outputs the pulse signals of a prescribed sequence to conveyor roller driving motor 214, and conveyor roller driving motor 214 starts rotation. Further, CPU 200 acquires information representing the current time (hereinafter simply referred to as current time) from timer 208, and stores it as information representing the start time (hereinafter simply referred to as start time) in a prescribed area of RAM 204.

At step 304, CPU 200 determines whether or not a prescribed time period Ta has passed from the start of rotation of conveyor roller pair (pre-registration roller pair) 12*e*. Specifically, CPU 200 obtains the current time from timer 208, calculates the elapsed time from the start time stored in RAM 204 at step 302, and determines whether the resulting value is longer than the time period Ta. If it is determined that the time period Ta has passed, the control proceeds to step 306. Otherwise, step 304 is repeated.

Figure 7:
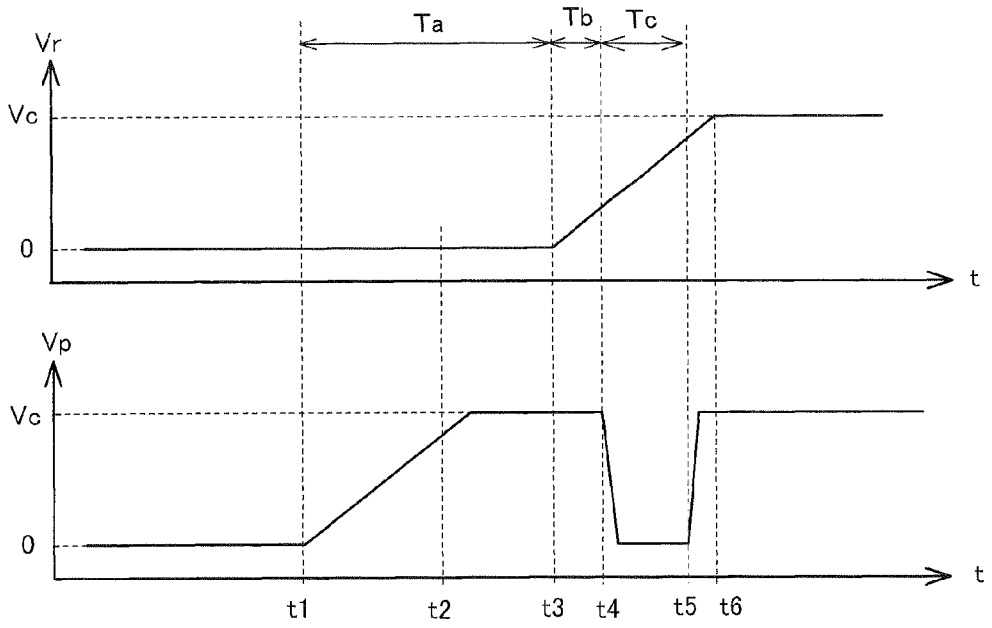
FIG. 7 is a timing chart representing an example of control waveforms of the registration roller pair and the pre-registration roller pair in the image forming apparatus in accordance with the first embodiment of the present invention.
Figure 8:
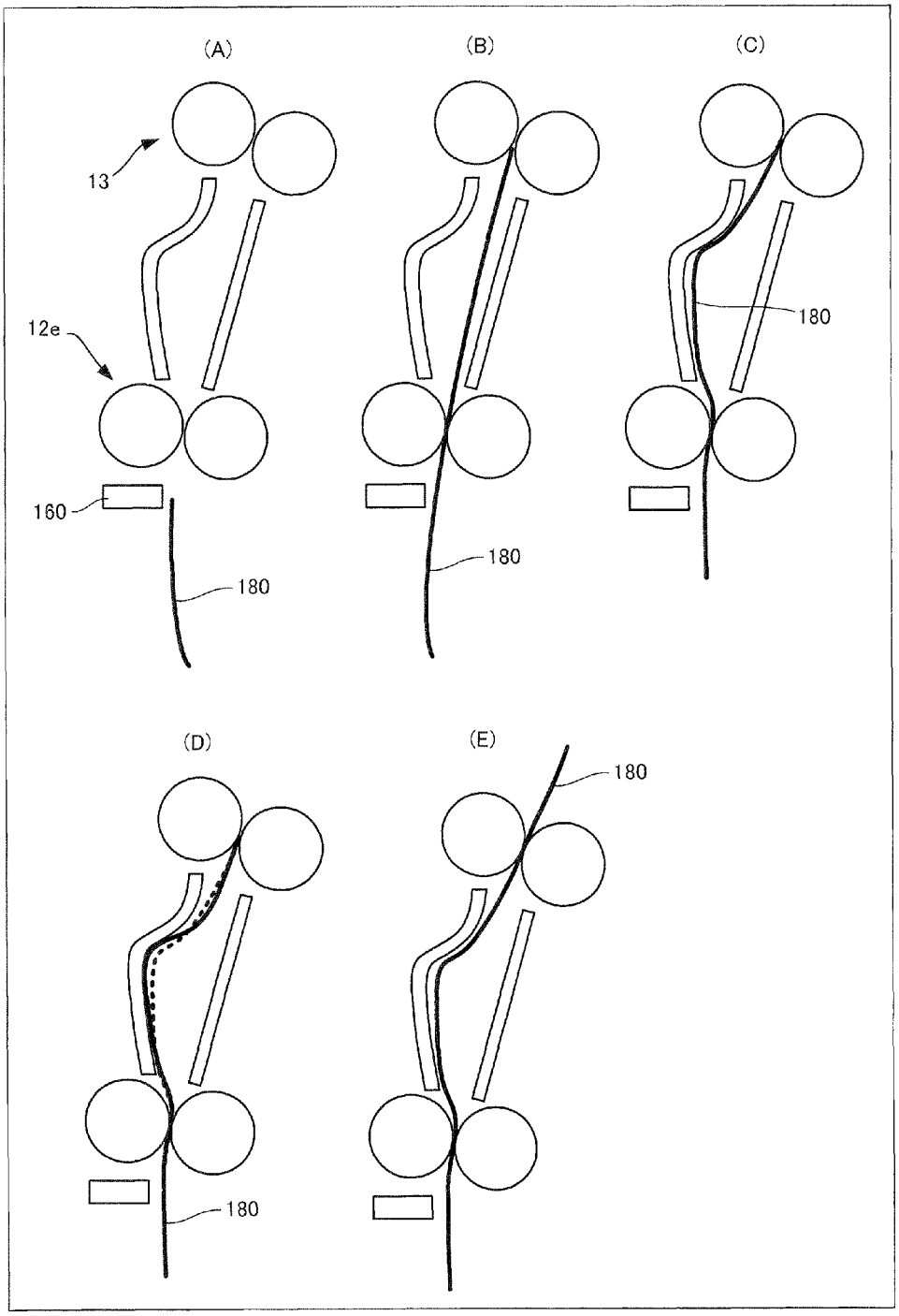
FIG. 8 shows a state of feeding a sheet of recording paper by the registration roller pair and the pre-registration roller pair in the image forming apparatus in accordance with the first embodiment of the present invention.

This stage corresponds to time t1 to t3 of FIG. 7. The upper part of the graph of FIG. 7 shows time-change of velocity Vr of the registration roller pair, and the lower part of the graph shows time-change of velocity Vp of the pre-registration roller pair. At time t1, the leading edge of the sheet of recording paper is detected by sensor 160, that is, the sheet of recording paper reaching pre-registration roller pair 12*e* is detected, pre-registration roller pair 12*e* starts rotation, and the sheet of recording paper is introduced between the first and second conveyor guides 150 and 152. Thereafter, at time t2, the leading edge of the sheet of recording paper abuts registration roller pair 13. Since registration roller pair 13 is stopped, the sheet of recording paper deflects along the first conveyor guide 150. Referring to FIG. 8, (A) shows a state in which recording paper 180 is detected by sensor 160; (B) shows a state in which the leading edge of recording paper 180 abuts the registration roller pair 13; and (C) shows a state in which recording paper 180 deflects along the first conveyor guide 150.

At step 306, CPU 200 transmits a control signal for rotating registration roller pair 13 to motor driver 210. In response, motor driver 210 outputs pulse signals of a prescribed sequence to registration roller driving motor 212, and registration roller driving motor 212 starts rotation. Further, CPU 200 obtains the current time from timer 208, and temporarily stores it as the start time, in a prescribed area of RAM 204.

At step 308, CPU 200 determines whether or not a prescribed time period Tb has passed from the start of rotation of registration roller pair 13. Specifically, CPU 200 obtains the current time from timer 208, calculates the elapsed time from the start time stored in RAM 204 at step 306, and determines whether the resulting value is longer than the time period Tb. If it is determined that the time period Tb has passed, the control proceeds to step 310. Otherwise, step 308 is repeated. This stage corresponds to t3 to t4 of FIG. 7. Though pre-registration roller pair 12*e* is rotating at a constant final velocity Vc, registration roller pair 13 has not yet reached the final velocity Vc. Specifically, the velocity at which the sheet of recording paper is introduced into the space between the first and second conveyor guides 150 and 152 by pre-registration roller pair 12*e* is faster than the velocity at which the sheet of recording paper is fed out from registration roller pair 13. Thus, the sheet of recording paper is further deflected. This state is shown in (D) of FIG. 8. In (D) of FIG. 8, the dotted line represents the sheet of recording paper 180 in the state of (C). In the state of (D), recording paper 180 is more deflected than in the state of (C).

At step 310, CPU 200 transmits a control signal for stopping conveyor roller pair (pre-registration roller pair) 12*e* to motor driver 210. In response, motor driver 210 outputs pulse signals of a prescribed sequence to conveyor roller driving motor 214, and the rotation of conveyor roller driving motor 214 is suspended. Further, CPU 200 obtains the current time from timer 208, and temporarily stores it as the start time, in a prescribed area of RAM 204.

At step 312, CPU 200 determines whether or not a prescribed time period Tc has passed from when rotation of conveyor roller pair (pre-registration roller pair) 12*e* is suspended. Specifically, CPU 200 obtains the current time from timer 208, calculates the elapsed time from the start time stored in RAM 204 at step 310, and determines whether the resulting value is longer than the time period Tc. If it is determined that the time period Tc has passed, the control proceeds to step 314. Otherwise, step 312 is repeated. In this stage (the time period from t4 to t5 of FIG. 7), registration roller pair 13 is rotating, while pre-registration roller pair 12*e* is stopped. Therefore, pre-registration roller pair 12*e* does not feed the sheet into the space between the first and second conveyor guides 150 and 152, and the sheet of recording paper is fed out from registration roller pair 13, so that deflection of the sheet of paper is reduced. This state is shown in (E) of FIG. 8. In (E) of FIG. 8, the sheet of recording paper 180 is returned to the state shown by the dotted line in (D), with the deflection reduced. Actually, considering the rising time of motor, the deflection of the sheet is also reduced during the rising time from t5.

At step 314, CPU 200 transmits a control signal for rotating conveyor roller pair (pre-registration roller pair) 12*e* to motor driver 210. In response, motor driver 210 outputs pulse signals of a prescribed sequence to conveyor roller driving motor 214, and conveyor roller driving motor 214 starts rotation.

At step 316, CPU 200 determines whether or not registration roller pair 13 has completed feeding of the sheet of recording paper. By way of example, if a sensor for detecting a trailing edge of the sheet of recording paper is arranged on the downstream side of registration roller pair 13, CPU 200 determines the signal level of the sensor. Alternatively, CPU 200 may determine whether or not a prescribed time period has passed from the start of rotation of conveyor roller pair (pre-registration roller pair) 12*e* at step 314. If it is determined that feeding of the sheet of recording paper is completed, the control proceeds to step 318. Otherwise, step 316 is repeated.

At step 318, CPU 200 transmits a control signal for stopping registration roller pair 13 and conveyor roller pair (pre-registration roller pair) 12*e* to motor driver 210. In response, motor driver 210 outputs pulse signals of a prescribed sequence to registration roller driving motor 212 and conveyor roller driving motor 214, and registration roller driving motor 212 and conveyor roller driving motor 214 are stopped.

At step 320, CPU 200 determines whether or not an end instruction has been received. The end instruction is, for example, turning OFF of the power of image forming apparatus 100. If it is determined that an end instruction is received, the present program ends. Otherwise, the control returns to step 300. Thus, when image forming apparatus 100 is operated by a user and printing of a prescribed number of copies is instructed, the above-described process is repeated until printing of the prescribed number of copies is completed.

Figure 9:
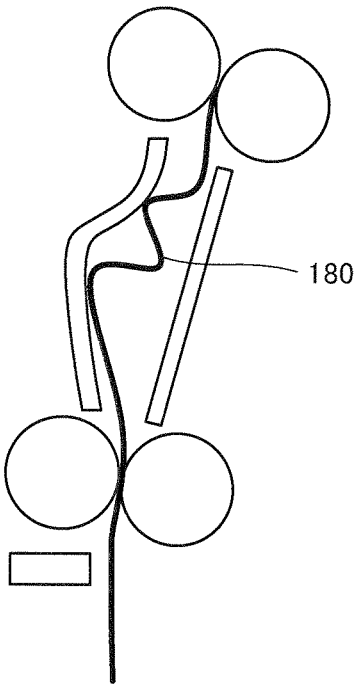
FIG. 9 shows a state where the sheet of recording paper is buckled.

As described above, in image forming apparatus 100, when a sheet of recording paper is fed to pre-registration roller pair 12*e* (time t1), rotation of pre-registration roller pair 12*e* is started to have the leading edge of the sheet of recording paper abut registration roller pair 13 that is stationary (time t2), and pre-registration roller pair 12*e* is continuously rotated thereafter. Thus, the sheet of recording paper is appropriately deflected between the first and second conveyor guides 150 and 152. In image forming apparatus 100, at a time point (time t3) when the sheet of recording paper is deflected appropriately, rotation of registration roller pair 13 is started, at a time point (time t4) when a prescribed time period (Tb) thereafter has passed, rotation of pre-registration roller pair 12*e* is suspended, and at a time point (time t5) when a prescribed time period (Tc) thereafter has passed, pre-registration roller pair 12*e* is again rotated. Thus, as shown in FIG. 9, excessive deflection and buckling of the sheet of recording paper more than necessary for skew correction can be prevented. Thereafter, in image forming apparatus 100, it is preferred that pre-registration roller pair 12*e* is returned to rotation of the constant velocity (Vc) before the suspension and registration roller pair 13 is accelerated to the same constant velocity (Vc) as the pre-registration roller pair 12*e*. In that case, after pre-registration roller pair 12*e* and registration roller pair 13 have reached the same velocity (after time t6), the sheet of recording paper is fed by registration roller pair 13 with appropriate deflection of the sheet maintained. Therefore, the sheet of recording paper with the skew corrected is fed to transfer roller 10. When the sheet of recording paper leaves and is away from pre-registration roller pair 12*e*, deflection of the sheet is not maintained, while skew-correction of the sheet of recording paper is maintained by registration roller pair 13.

The time periods Ta to Tc may be appropriately set in consideration of the specification of image forming apparatus (such as the number of sheets that can be handled per unit time), characteristics of stepping motors driving the registration roller pair and the conveyor roller pair, the amount of deflection of the sheet of recording paper and the like.

Though feeding of a sheet of recording paper has been described above, the application is not limited to the above. By way of example, the invention is also applicable to automatic document feeder 120 for feeding a document to a scanning position. This will be specifically described in the following.

Figure 10:
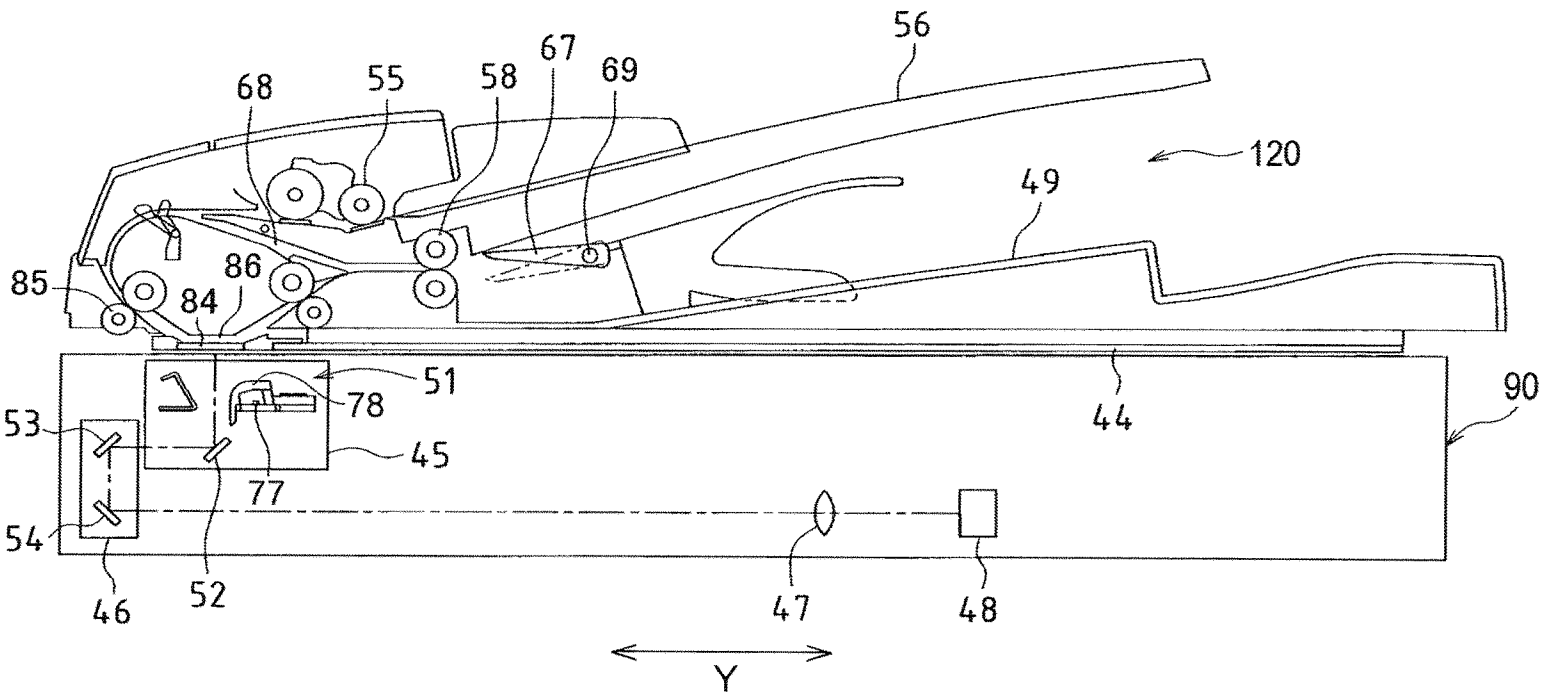
FIG. 10 is a cross-sectional view showing the automatic document feeding device and the image reading device of the image forming apparatus shown in FIG. 3.

Referring to FIG. 10, automatic document feeder 120 has a deep side pivotally supported by means of a hinge (not shown) on a deep side of image reading device 90, and it is opened/closed by moving upward/downward its front portion. When automatic document feeder 120 is opened, platen glass 44 of image reading device 90 is opened, and a document can be placed on platen glass 44.

Image reading device 90 includes a platen glass 44, a first scanning unit 45, a second scanning unit 46, an image forming lens 47, and a CCD (Charge Coupled Device) 48. When a document placed on platen glass 44 is read, the first and second scanning units 45 and 46 are used.

The first scanning unit 45 includes an illumination device 51 and a first reflection mirror 52. Illumination device 51 includes an LED array 77 and a light guiding member 78. The first scanning unit 45 moves at a constant velocity V to a sub-scanning direction Y by a distance corresponding to the document size, while exposing the document on platen glass 44 using illumination device 51. The first scanning unit 45 reflects reflected light by the first reflection mirror 52 to the second scanning unit 46. In this manner, the first scanning unit 45 scans an image (including color or black-and-white characters, a figure, a photograph or the like) on the surface of the document in the sub-scanning direction Y. The second scanning unit 46 includes a second reflection mirror 53 and a third reflection mirror 54. The second scanning unit 46 moves at a velocity V/2 following the first scanning unit 45, and reflects the light reflected from the document by the second and third reflection mirrors 53 and 54 to image forming lens 47. Image forming lens 47 collects the light reflected from the document to CCD 48, and forms an image of the document surface on CCD 48. CCD 48 scans the document image repeatedly in the main scanning direction (the direction vertical to the surface of FIG. 10), and at every scanning, outputs analog image signals of one main scanning line. The document is scanned in this manner and image data is produced.

Image reading device 90 can read not only the stationary document on platen glass 44 but also images on the surface of a document fed by automatic document feeder 120. In that case, the first scanning unit 45 is moved to a reading area below document reading glass 84 as shown in FIG. 10, and the second scanning unit 46 is arranged corresponding to the position of the first scanning unit 45. In this state, feeding of document by automatic document feeder 120 starts.

In automatic document feeder 120, a pick-up roller 55 is rotated with the roller pressed on a document on document tray 56, to draw a sheet of document. Automatic document feeder 120 conveys the drawn document to have the leading edge of the document abut a registration roller pair 85, so as to align the leading edge of document, and then, passes the document through document reading glass 84 and a reading guide plate 86, and discharges the document through a discharge roller pair 58 to a discharge tray 49.

When the document is fed, illumination device 51 of the first scanning unit 45 illuminates the document surface through document reading glass 84. The light reflected from the document surface is guided by the reflection mirrors of the first and second scanning units 45 and 46 to image forming lens 47, collected by image forming lens 47 to CCD 48, and the image on the document surface is formed on CCD 48. In this manner, image reading device 90 reads the image on the document surface.

When the back side of the document is to be read, in automatic document feeder 120, an intermediate tray 67 is rotated about its shaft 69 as represented by a chain-dotted line, and while the document is discharged from discharge roller pair 58 to discharge tray 49, discharge roller pair 58 is stopped, and the document is received by intermediate tray 67. In this state, in automatic document feeder 120, discharge roller pair 58 is rotated in reverse direction, so that the document is guided through a reverse feeding path 68 to registration roller pair 85, and the document is turned over. In the similar manner as reading the image on the front side, image reading device 90 reads the image on the back side of the document. Thereafter, automatic document feeder 120 returns the intermediate tray 67 to the original position represented by the solid line, and discharges the document through discharge roller pair 58 to discharge tray 49.

If the document fed by registration roller pair 85 passes askew through document reading glass 84 and reading guide plate 86, the document will be scanned askew, and desired image data cannot be obtained. Therefore, as in image forming, skew correction here is also desirable.

When the front surface of a document is to be read, a process similar to the process of steps 300 to 318 may be executed, in which registration roller pair 85 serves as registration roller pair 13 for feeding the sheet of recording paper and pick-up roller 55 serves as pre-registration roller pair 12*e*. When the back surface of the document is to be read, the process similar to the process of steps 300 to 318 may be executed, in which registration roller pair 85 serves as registration roller pair 13 for feeding the sheet of recording paper and discharge roller pair 58 for reverse rotation serves as pre-registration roller pair 12*e*. By such an approach, no matter whether the front surface or back surface of the document is to be read, the document can be passed between document reading glass 84 and reading guide plate 86 with the skew corrected.

In place of using pick-up roller 55 as pre-registration roller pair 12*e*, a new conveyor roller pair may be provided along the document feeding path between pick-up roller 55 and registration roller pair 85 (for example, at a position closer to registration roller pair 85 than pick-up roller 55), and the process similar to the process of steps 300 to 318 may be executed using the new conveyor roller pair as pre-registration roller pair 12*e*. In that case, also when the back surface of the document is read, similar to the process of steps 300 to 318 may be executed, using the new conveyor roller pair as pre-registration roller pair 12*e*.

In the foregoing, an example in which the amount of deflection of the sheet of recording paper is adjusted by CPU 200 in accordance with the elapsed time has been described. The example above, however, is not limiting. By way of example, CPU 200 may adjust the amount of deflection of the sheet of recording paper by determining whether or not a prescribed number of pulses have been transmitted to registration roller driving motor 212 or to conveyor roller driving motor 214. CPU 200 may obtain the number of pulses transmitted to registration roller driving motor 212 and to conveyor roller driving motor 214 from, for example, motor driver 210.

Figure 11:
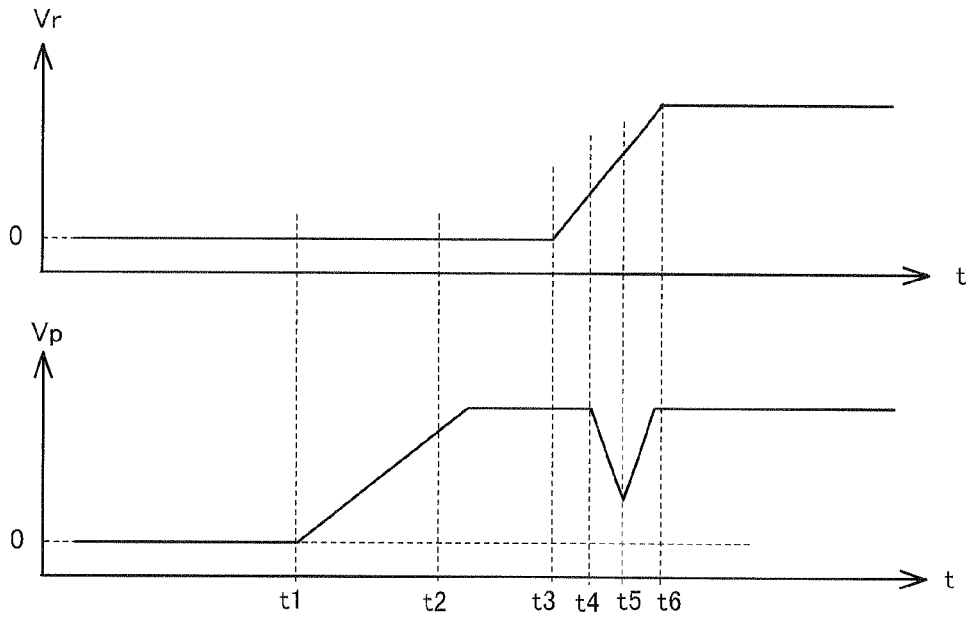
FIG. 11 is a timing chart representing an example of control waveforms of the registration roller pair and the pre-registration roller pair in the image forming apparatus in accordance with the first embodiment of the present invention, different from FIG. 7.
Figure 12:
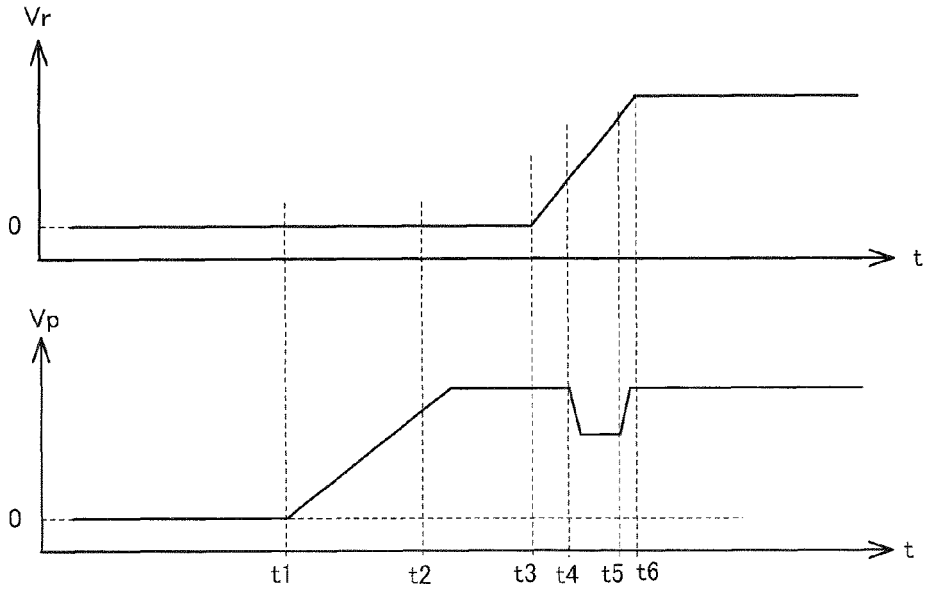
FIG. 12 is a timing chart representing an example of control waveforms of the registration roller pair and the pre-registration roller pair in the image forming apparatus in accordance with the first embodiment of the present invention, different from FIGS. 7 and 11.

Further, though an example in which the conveyor roller pair is fully stopped after the time period Tb from the start of rotation of registration roller pair 13 has been described, the example is not limiting. By way of example, as shown in FIGS. 11 and 12, after time period Tb from the start of rotation of registration roller pair 13 (between t3 and t4), the velocity of rotation of conveyor roller pair (pre-registration roller pair) 12*e* may be once reduced, and before it stops, it may be accelerated again. This prevents excessive deflection and buckling of the sheet of recording paper more than necessary to correct any skew, as shown in FIG. 9. For instance, if it takes a short time until registration roller pair 13 attains to the prescribed constant velocity Vc, the control such as shown in FIG. 11 or 12 may be effective.

Further, as shown in FIG. 7, if the rotations of registration roller pair 13 and pre-registration roller pair 12*e* are controlled, the sequence of pulse signals for appropriately deflecting the sheet of recording paper to correct any skew can be specified in accordance with the characteristics of recording paper conveying mechanism of image forming apparatus 100. Specifically, in accordance with the constant velocity of rotation Vc of registration roller pair 13 and pre-registration roller pair 12*e* and control characteristics of registration roller driving motor 212 and conveyor roller driving motor 214, the time periods from t1 to t3, t3 to t4 and t4 to t5, the rising time from the stationary state to the constant velocity of rotation, and the falling time from the constant velocity of rotation to stop of operation may be determined appropriately. If the determined pulse sequence is used, it is unnecessary to determine the elapsed time or the number of pulses transmitted to the motors. By way of example, if it is detected by sensor 160 that the leading edge of the sheet of recording paper reached pre-registration roller pair 12*e*, what is necessary is simply to transmit a prescribed signal from CPU 200 to motor driver 210. Thereafter, motor driver 210 have only to read the pulse signals of a prescribed sequence (a pulse sequence that forms the overall velocity waveforms as shown in FIG. 7) from ROM 202 and output the same to registration roller driving motor 212 and conveyor roller driving motor 214.

If CPU 200 controls motor driver 210 by determining the elapsed time or the number of pulses transmitted to the motor, what can be controlled by CPU 200 is the timing of transmitting the control signals. Therefore, the velocity waveforms of the roller are determined at time points t1, t4 and t5 (see FIG. 7) when CPU 200 transmits the control signals to motor driver 210. If the pulse sequences of overall waveforms such as shown in FIG. 7 are determined in advance, the object of control is only the first time point t1, and the following pulse sequences are all determined.

Since the timing at which feeding of the sheet of recording paper is completed is substantially constant, pulse sequences including the timing of stopping registration roller pair 13 and pre-registration roller pair 12*e* can also be determined. If such pulse sequences are used, provision of a sensor for detecting the trailing edge of the sheet of recording paper on the downstream side of registration roller pair 13 becomes unnecessary.

In the foregoing, an example in which motors for driving registration roller pair 13 and pre-registration roller pair 12*e* are provided respectively has been described. This example, however, is not limiting. By way of example, using electromagnetic clutches, registration roller pair 13 and pre-registration roller pair 12*e* may be driven by one motor. Specifically, a first electromagnetic clutch for transmitting motor rotation to registration roller pair 13 and a second electromagnetic clutch for transmitting motor rotation to pre-registration roller pair 12*e* may be provided, and control signals are supplied from the CPU to the first and second electromagnetic clutches, to connect or open the first and second electromagnetic clutches. By such an approach, rotations of registration roller pair 13 and pre-registration roller pair 12*e* can be controlled as shown in FIG. 7.

In the foregoing, an example of step 300 has been described in which rotation of pre-registration roller pair 12*e* is started when a sheet of recording paper is detected by sensor 160 and even when the leading edge of the sheet reaches near registration roller pair 13, rotation of pre-registration roller pair 12*e* is not suspended so that the leading edge of the sheet of recording paper abuts the registration roller pair. This example, however, is not limiting. As in the conventional art, when the leading edge of the sheet of recording paper reaches near registration roller pair 13, pre-registration roller pair 12*e* may be temporarily stopped. In that case, from this suspended state of pre-registration roller pair 12*e*, step 302 may be executed at time t1. Here, the time period between t1 and t2 is short, and since the leading edge of the sheet of recording paper abuts registration roller pair 13 at a low velocity, hitting sound (collision noise) can be reduced.

Second Embodiment

An image forming apparatus in accordance with a second embodiment of the present invention has the same configuration as the image forming apparatus in accordance with the first embodiment described with reference to FIG. 3. Skew correction of the sheet of recording paper in the image forming apparatus in accordance with the second embodiment, that is, the process for deflecting the sheet of recording paper just in front of registration roller pair 13 is the same as described with reference to FIG. 4 above. Further, the mechanism for driving registration roller pair 13 and conveyor roller pair 12*e* in the image forming apparatus in accordance with the second embodiment is the same as that described with reference to FIG. 5. Therefore, accumulative description will not be repeated. In the following, the image forming apparatus in accordance with the second embodiment will be denoted as "image forming apparatus 100", and description will be given with reference to FIGS. 1 to 5 for convenience.

Figure 13:
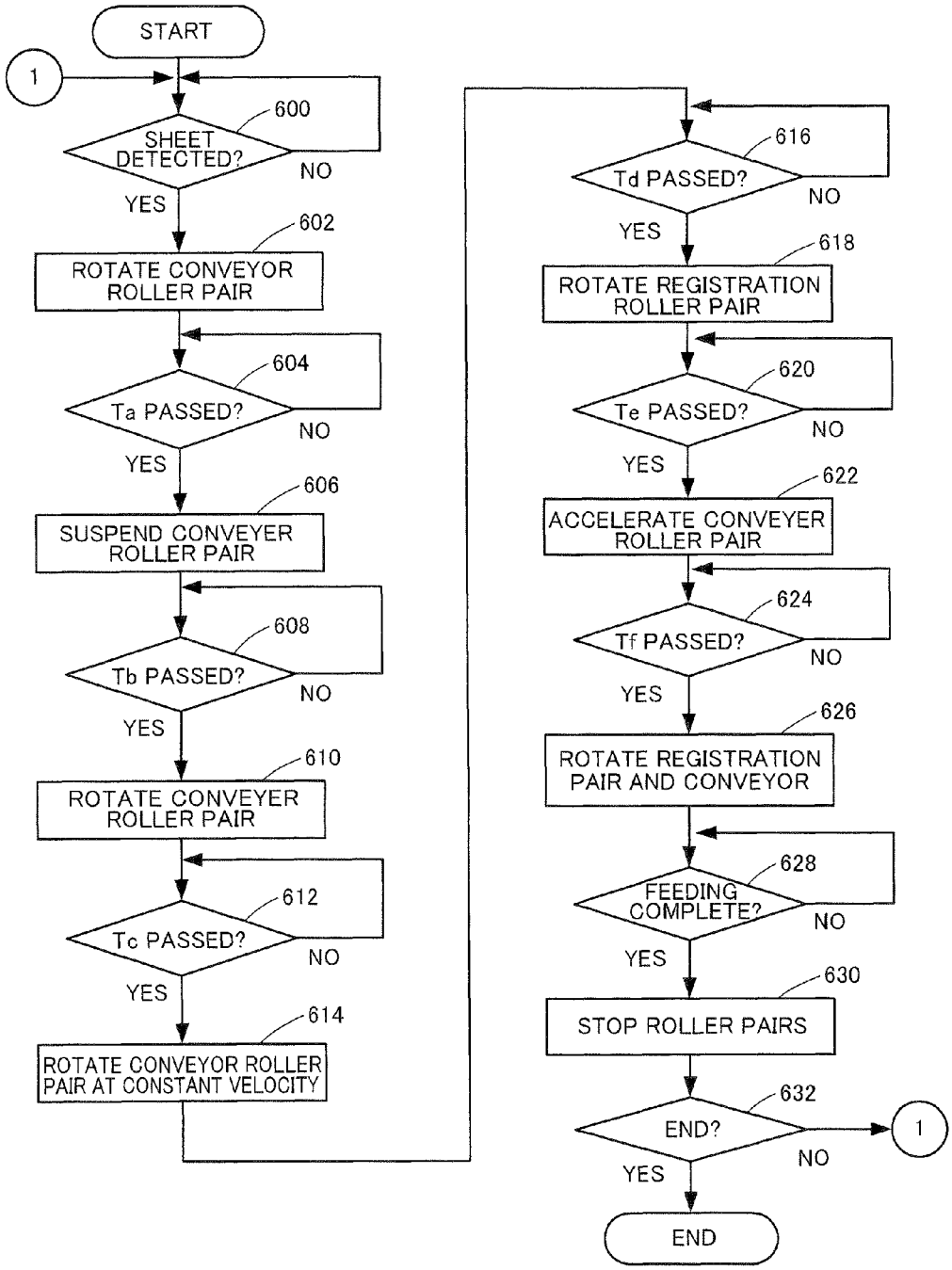
FIG. 13 is a flowchart representing a control structure of a program executing skew correction in the image forming apparatus in accordance with a second embodiment of the present invention.

Referring to FIG. 13, the program for executing skew correction in image forming apparatus 100 in accordance with the second embodiment will be described. In the first state, registration roller pair 13 and pre-registration roller pair 12*e* are stopped. In ROM 202 or HDD 206, time periods Ta to Tf, which will be described later, are stored.

At step 600, CPU 200 determines whether or not sensor 160 has detected a sheet of recording paper. Specifically, CPU 200 determines whether or not the signal from sensor 160 is at a level that is output when a sheet of recording paper is detected. By way of example, the output signal from sensor 160 is at the low level when no sheet is detected, and it attains to the high level when a sheet of recoding paper is detected. If it is determined that a sheet of recording paper is detected, the control proceeds to step 602. Otherwise, step 600 is repeated.

At step 602, CPU 200 transmits a control signal for rotating the pre-registration roller pair (conveyor roller pair) 12*e* to motor driver 210. Receiving the control signal, motor driver 210 outputs the pulse signals of prescribed sequence to conveyor roller driving motor 214 as described above. Receiving the pulse signals, conveyor roller driving motor 214 starts rotation, and thus, pre-registration roller pair 12*e* rotates. Further, CPU 200 obtains the current time from timer 208, and stores it as the start time in a prescribed area of RAM 204.

At step 604, CPU 200 determines whether or not a prescribed time period Ta has passed from the start of rotation of pre-registration roller pair 12*e*. Specifically, CPU 200 obtains the current time from timer 208, calculates the elapsed time from the start time stored in RAM 204 at step 602, and determines whether the resulting value is longer than the time period Ta. If it is determined that the time period Ta has passed, the control proceeds to step 606. Otherwise, step 604 is repeated.

At step 606, CPU 200 transmits a control signal for stopping pre-registration roller pair 12*e* to motor driver 210. Receiving the control signal, motor driver 210 stops output of the pulse signals to conveyor roller driving motor 214. Consequently, conveyor roller driving motor 214 stops, and rotation of pre-registration roller pair 12*e* is suspended. Here, if the rotation is to be suspended with the number of rotations controlled, for example, the number of pulses per unit time is reduced linearly to zero. Further, CPU 200 obtains the current time from timer 208, and temporarily stores it as the start time in a prescribed area of RAM 204.

Figure 14:
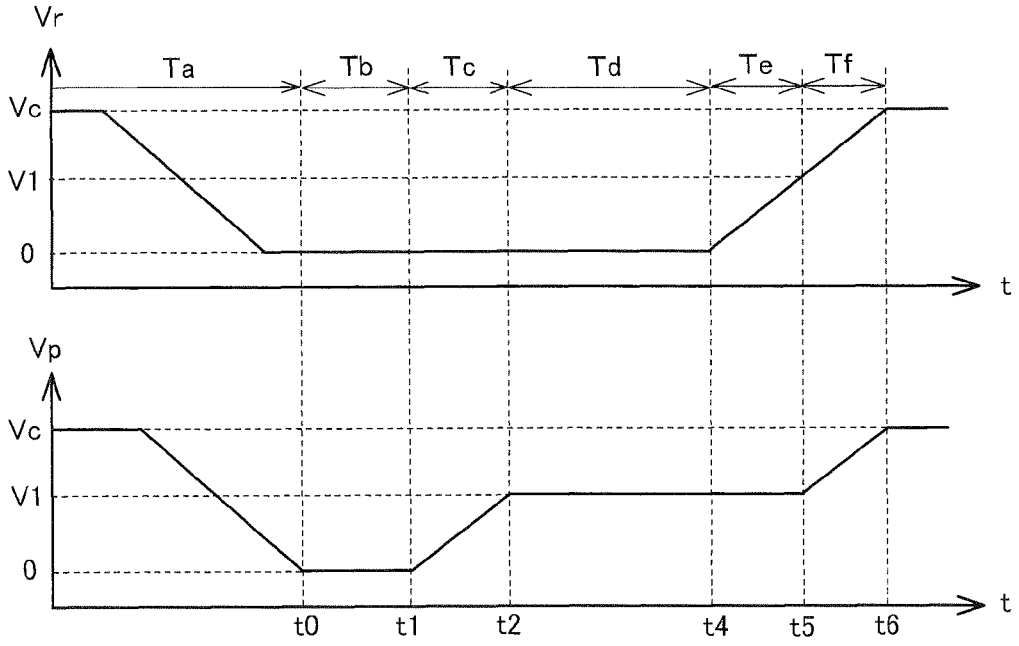
FIG. 14 is a timing chart representing an example of control waveforms of the registration roller pair and the pre-registration roller pair in the image forming apparatus in accordance with the second embodiment of the present invention.
Figure 15:
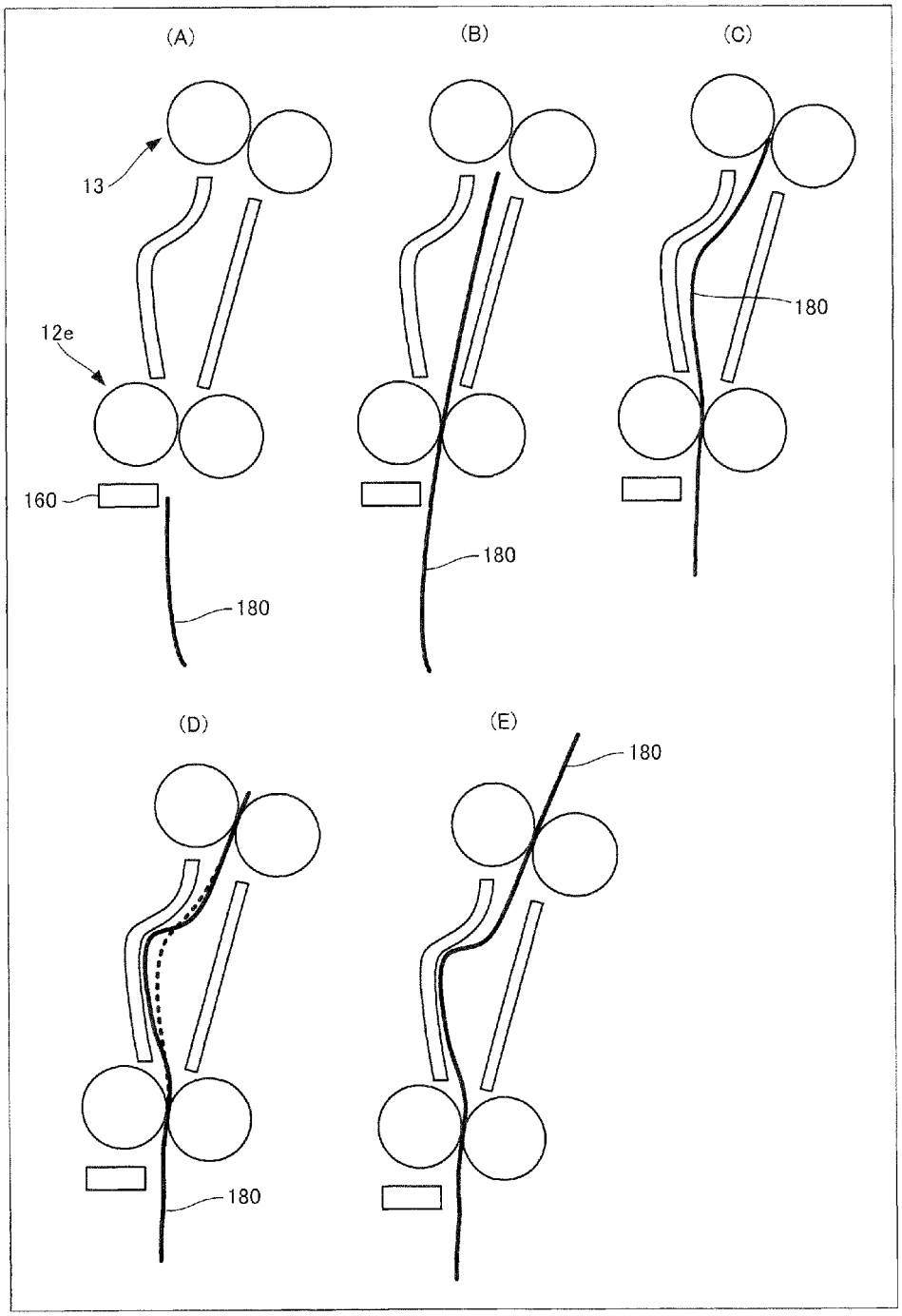
FIG. 15 shows a state of feeding a sheet of recording paper by the registration roller pair and the pre-registration roller pair in the image forming apparatus in accordance with the second embodiment of the present invention.

Steps 600 to 606 are executed in a time period up to time t0 of FIG. 14. The upper part of the graph of FIG. 14 shows time-change of the velocity Vr of registration roller pair 13, and the lower part of the graph represents time-change of the velocity Vp of pre-registration roller pair 12*e*. FIG. 14 does not show the timing when pre-registration roller pair 12*e* starts rotation at step 602. As the pre-registration roller pair 12*e* rotates with the sheet of recording paper pinched therebetween, the sheet of recording paper is fed into the space between the first and second conveyor guides 150 and 152. Thereafter, at time t0, pre-registration roller pair 12*e* is stopped. Therefore, by appropriately setting the time period Ta, it is possible to stop the leading edge of the sheet of recording paper at a position apart by a prescribed distance from registration roller pair 13 (for example, near and just in front of registration roller pair 13). Referring to FIG. 15, (A) shows a state in which sensor 160 detected recording paper 180, and (B) shows a state in which the leading edge of recording paper 180 is stopped just in front of registration roller pair 13.

At step 608, CPU 200 determines whether or not a prescribed time period Tb has passed after pre-registration roller pair 12*e* was stopped at time t0. Specifically, CPU 200 obtains the current time from timer 208, calculates the elapsed time from the start time stored in RAM 204 at step 606, and determines whether the resulting value is longer than the time period Tb. If it is determined that the time period Tb has passed, the control proceeds to step 610. Otherwise, step 608 is repeated.

At step 610, CPU 200 transmits a control signal for rotating pre-registration roller pair 12*e* to motor driver 210. Receiving the control signal, motor driver 210 outputs pulse signals of a prescribed sequence (for example, a sequence in which number of pulses per unit time increases linearly) to conveyor roller driving motor 214. Receiving the pulse signals, conveyor roller driving motor 214 starts rotation. Consequently, pre-registration roller pair 12*e* starts rotation, and the velocity of rotation is increased at a constant rate of acceleration. Further, CPU 200 obtains the current time from timer 208, and stores it as the start time in a prescribed area of RAM 204. Step 610 is executed at time t1 of FIG. 14.

At step 612, CPU 200 determines whether or not a prescribed time period Tc has passed from the start of rotation of pre-registration roller pair 12*e* at time t1. Specifically, CPU 200 obtains the current time from timer 208, calculates the elapsed time from the start time stored in RAM 204 at step 610, and determines whether the resulting value is longer than the time period Tc. If it is determined that the time period Tc has passed, the control proceeds to step 614. Otherwise, step 612 is repeated.

The time period in which steps 610 to 612 are executed is the period from t1 to t2 of FIG. 14. Before pre-registration roller pair 12*e* starts rotation at step 610, the leading edge of the sheet of recording paper is just in front of registration roller pair 13 and, therefore, in a short period of time after pre-registration roller pair 12*e* starts rotation, the sheet of recording paper abuts registration roller pair 13. Therefore, the hitting sound (collision noise) when the leading edge of the sheet of recording paper abuts registration roller pair 13 can be reduced. When the leading edge of recording paper abuts registration roller pair 13, registration roller pair 13 is stopped and, therefore, the sheet of recording paper deflects along the first conveyor guide 150.

At step 614, CPU 200 transmits a control signal to have pre-registration roller pair 12*e*, which is rotating with acceleration, rotate at a constant velocity (control signal to stop acceleration) to motor driver 210. Receiving the control signal, motor driver 210 outputs pulse signals of a prescribed sequence (for example, pulse signals of equal interval) to conveyor roller driving motor 214. Receiving the control signal, conveyor roller driving motor 214 stops acceleration, and rotates at a constant velocity. Thus, pre-registration roller pair 12*e* comes to rotate at a constant velocity V1. Further, CPU 200 obtains the current time from timer 208, and stores it as the start time in a prescribed area of RAM 204. Step 614 is executed at time t2 of FIG. 14.

At step 616, CPU 200 determines whether a prescribed time period Td has passed from when rotation of pre-registration roller pair 12*e* at constant velocity V1 started at time t2. Specifically, CPU 200 obtains the current time from timer 208, calculates the elapsed time from the start time stored in RAM 204 at step 614, and determines whether the resulting value is longer than the time period Td. If it is determined that the time period Td has passed, the control proceeds to step 618. Otherwise, step 616 is repeated.

At step 618, CPU 200 transmits a control signal for rotating registration roller pair 13 to motor driver 210. Receiving the control signal, motor driver 210 outputs pulse signals of a prescribed sequence (for example, a sequence in which number of pulses per unit time increases linearly) to registration roller driving motor 212. Receiving the pulse signals, registration roller driving motor 212 starts rotation. Accordingly, registration roller pair 13 starts rotation, and the rotation accelerates at the same constant rate of acceleration as that of pre-registration roller pair 12*e* at step 610. Further, CPU 200 obtains the current time from timer 208, and stores it as the start time in a prescribed area of RAM 204. Step 618 is executed at time t4 of FIG. 14. In FIG. 15, (C) shows a state in which recording paper 180 is deflected along the first conveyor guide 150 (appropriately deflected by an amount necessary for skew correction) at time t4.

At step 620, CPU 200 determines whether or not a prescribed time period Te has passed from the start of rotation of registration roller pair 13 at time t4. Specifically, CPU 200 obtains the current time from timer 208, calculates the elapsed time from the start time stored in RAM 204 at step 618, and determines whether the resulting value is longer than the time period Te. If it is determined that the time period Te has passed, the control proceeds to step 622. Otherwise, step 620 is repeated.

At step 622, CPU 200 transmits a control signal for accelerating the rotation of pre-registration roller pair 12*e* to motor driver 210. Receiving the control signal, motor driver 210 outputs pulse signals of a prescribed sequence (for example, a sequence in which number of pulses per unit time increases linearly) to conveyor roller driving motor 214. Receiving the pulse signals, rotation of conveyor roller driving motor 214 accelerates. Thus, rotation of pre-registration roller pair 12*e* accelerates at the same constant rate of acceleration as in the time period between t1 and t2. Further, CPU 200 obtains the current time from timer 208, and stores it as the start time in a prescribed area of RAM 204. Step 622 is executed at time t5 of FIG. 14. The time t5 is when the velocity of rotation of registration roller pair 13 becomes equal to the velocity of rotation V1 of pre-registration roller pair 12*e* rotating at the constant velocity.

After the start of rotation of registration roller pair 13 at step 618 until immediately before the start of acceleration of pre-registration roller pair 12*e* at step 622, pre-registration roller pair 12*e* is rotating at the constant velocity V1, while the velocity of registration roller pair 13 is not yet as high as V1. Therefore, the velocity at which the sheet of recording paper is introduced into the space between the first and second conveyor guides 150 and 152 by pre-registration roller pair 12*e* is faster than the velocity at which the sheet of recording paper is fed out from registration roller pair 13. Thus, the sheet of recording paper further deflects. This state is shown in (D) of FIG. 15. In FIG. 15, (D) shows the state in which recording paper 180 is deflected along the first conveyor guide 150 at time t5. In (D) of FIG. 15, the dotted line represents the sheet of recording paper 180 in the state of (C). In the state of (D), recording paper 180 is more deflected than in the state of (C).

At step 624, CPU 200 determines whether or not a prescribed time period Tf has passed from when acceleration of the rotation of pre-registration roller pair 12*e* was started at time t5. Specifically, CPU 200 obtains the current time from timer 208, calculates the elapsed time from the start time stored in RAM 204 at step 622, and determines whether the resulting value is longer than the time period Tf. If it is determined that the time period Tf has passed, the control proceeds to step 626. Otherwise, step 624 is repeated.

At step 626, CPU 200 transmits a control signal for rotating registration roller pair 13 and pre-registration roller pair 12*e* at a constant velocity (a control signal for stopping acceleration) to motor driver 210. Receiving the control signal, motor driver 210 outputs pulse signals of a prescribed sequence (for example pulse signals of equal interval) to registration roller driving motor 212 and conveyor roller driving motor 214. Receiving the pulse signals, registration roller driving motor 212 and conveyor roller driving motor 214 rotate at a constant process velocity (the velocity of feeding the recording paper at the time of image formation) Vc. Step 626 is executed at time t6 of FIG. 14.

After the start of acceleration of pre-registration roller pair 12*e* at time t5, registration roller pair 13 and pre-registration roller pair 12*e* are rotating at the same velocity. Therefore, the velocity at which the sheet of recording paper is fed out from registration roller pair 13 is the same as the velocity at which pre-registration roller pair 12*e* feeds the sheet of recording paper into the space between the first and second conveyor guides 150 and 152. Thus, the amount of deflection of the sheet of recording paper is kept constant. This state is shown in (E) of FIG. 15. Recording paper 180 is fed with the state of deflection between the first and second conveyor guides 150 and 152 kept the same as that shown by the solid line in (D).

At step 628, CPU 200 determines whether or not registration roller pair 13 has completed feeding of the sheet of recording paper. By way of example, if a sensor for detecting a trailing edge of the sheet of recording paper is arranged on the downstream side of registration roller pair 13, CPU 200 determines the signal level of the sensor. Alternatively, CPU 200 may determine whether or not a prescribed time period has passed from the start of rotation of pre-registration roller pair 12*e* at step 614. If it is determined that feeding of the recording paper has completed, the control proceeds to step 630. Otherwise, step 628 is repeated.

At step 630, CPU 200 transmits a control signal for stopping registration roller pair 13 and pre-registration roller pair 12*e* to motor driver 210. Receiving the control signal, motor driver 210 stops output of pulse signals to registration roller driving motor 212 and conveyor roller driving motor 214. Thus, rotations of registration roller driving motor 212 and conveyor roller driving motor 214 are stopped. Here, if the rotation is to be stopped with the number of rotations controlled, for example, the number of pulses per unit time is reduced linearly to zero.

At step 632, CPU 200 determines whether or not an end instruction has been received. The end instruction is, for example, turning OFF of the power of image forming apparatus 100. If it is determined that an end instruction is received, the present program ends. Otherwise, the control returns to step 600. Thus, when image forming apparatus 100 is operated by a user and printing of a prescribed number of copies is instructed, the above-described process is repeated until printing of the prescribed number of copies is completed.

As described above, in image forming apparatus 100, when a sheet of recording paper is fed to pre-registration roller pair 12*e*, rotation of pre-registration roller pair 12*e* is started to have the leading edge of the sheet of recording paper fed to immediately in front of registration roller pair 13 that is stationary, and then, rotation of pre-registration roller pair 12*e* is temporarily suspended (time t0). Thereafter, image forming apparatus 100 starts rotation of pre-registration roller pair 12*e* (time t1) to have the leading edge of the sheet of recording paper abut registration roller pair 13, and continuously rotates pre-registration roller pair 12*e* thereafter. Thus, the sheet of recording paper is appropriately deflected between the first and second conveyor guides 150 and 152 (time t4). In image forming apparatus 100, at a time point (time t4) when the sheet of recording paper is deflected appropriately, rotation of registration roller pair 13 is started, and at a time point (time t5) when a prescribed time period (Te) thereafter has passed, rotation of pre-registration roller pair 12*e* is again accelerated. Then, registration roller pair 13 and pre-registration roller pair 12*e* rotate at the same velocity and, hence, the sheet of recording paper is fed by registration roller pair 13 and pre-registration roller pair 12*e* with appropriate deflection of the sheet maintained, as shown in (D) of FIG. 15. Therefore, excessive deflection and buckling of the sheet of recording paper more than necessary for skew correction (see FIG. 9) can be prevented.

After a prescribed time period (Tf) from the start of re-acceleration of pre-registration roller pair 12*e* (time t6), image forming apparatus 100 has registration roller pair 13 and pre-registration roller pair 12*e* rotate at the constant velocity Vc. Thus, the sheet of recording paper with the skew corrected is fed to transfer roller 10. When the sheet of recording paper leaves and is away from pre-registration roller pair 12*e*, deflection of the sheet is not maintained, while skew-correction of the sheet of recording paper is maintained by registration roller pair 13.

The time periods Ta to Tf may be appropriately set in consideration of the specification required of image forming apparatus (such as the number of sheets that can be handled per unit time), characteristics of stepping motors driving the registration roller pair 13 and the conveyor roller pair 12*e*, the amount of deflection of the sheet of recording paper and the like.

The constant velocity V1 at which pre-registration roller pair 12*e* is rotated in the time period of t2 to t5 can also be set appropriately. If the velocity V1 is low, the time period Tc+Td (time t1-t4) from the start of rotation of pre-registration roller pair 12*e* until an appropriate deflection is formed becomes longer, while the amount of excessive deflection becomes smaller than in the conventional example. On the other hand, if the velocity V1 is high, the time period Tc+Td between time t1 and t4 becomes shorter, while the amount of excessive deflection becomes larger. This will be described with reference to FIG. 16.

Figure 16:
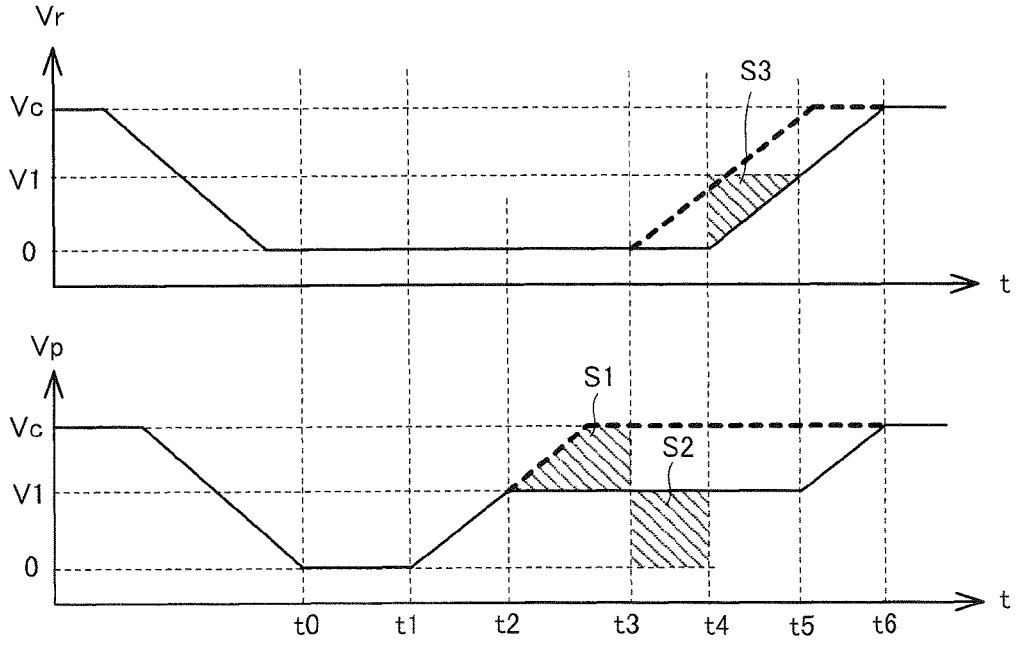
FIG. 16 shows the difference between the timing charts of FIGS. 1 and 14.

FIG. 16 is a combination of FIG. 14, the waveforms of FIG. 1 (in thick solid line) and time t3. Conventionally (FIG. 1), at time t3, an appropriate deflection is formed for skew correction. On the contrary, in the embodiment described above, pre-registration roller pair 12*e* is accelerated from the stationary state to the constant velocity V1 that is slower than the final process velocity Vc. Therefore, it takes longer to form the same deflection as in the conventional example. As shown in the lower part of FIG. 16, since the deflection formed corresponding to area S1 in the conventional example is not formed, it is necessary to maintain pre-registration roller pair 12*e* at the state of constant velocity V1 until time t4, so that an area S2 of the same size as area S1 is formed. At time t4, rotation of registration roller pair 13 starts. In this state, pre-registration roller pair 12*e* is at the constant velocity V1 and, therefore, as shown in the upper part of FIG. 16, unnecessary deflection corresponding to the area S3 between t4 and t5 is further formed. The time point t5 is when the velocity of registration roller pair 13 becomes equal to the velocity of pre-registration roller pair 12*e*. The size of area S1 is smaller than the area S0 (FIG. 1) of the conventional example. In other words, by the present embodiment, the amount of unnecessary deflection can be reduced.

As can be seen from FIG. 16, when the velocity V1 becomes smaller, the size of area S1 becomes larger, and therefore, in order to enlarge the size of area S2 accordingly, it becomes necessary to maintain pre-registration roller pair 12*e* at the constant velocity V1 for a longer time period. The time until registration roller pair 13 attains to the velocity V1, however, becomes shorter and, therefore, the area S1 becomes smaller and the unnecessary deflection becomes smaller. On the other hand, if the velocity V1 becomes higher, the area S1 becomes smaller and, therefore, pre-registration roller pair 12*e* have only to be maintained at the constant velocity V1 for a shorter time period, so that the area S2 becomes smaller accordingly. In that case, however, the time until registration roller pair 13 attains to the velocity V1 becomes longer, so that the area S1 becomes larger and the unnecessary deflection becomes larger. Then, it becomes more likely that recording paper 180 buckles as shown in FIG. 9. Therefore, the constant velocity V1 of pre-registration roller pair 12*e* should be set appropriately in consideration of the specification required of image forming apparatus (such as the number of sheets that can be handled per unit time), characteristics of stepping motors driving registration roller pair 13 and pre-registration roller pair 12*e*, the amount of deflection of the sheet of recording paper and the like. It is preferred to set the constant velocity V1 to a value close to the final process velocity Vc (for example, 580 mm/s) or a value not very much lower than the process velocity Vc, for example, to set to about at least one half the process velocity and smaller than the process velocity Vc. With such setting, unnecessary deflection can be reduced without sacrificing the performance of image forming apparatus, and an image forming apparatus reduced in size can be realized.

As described above, it is preferred that the rate of acceleration of pre-registration roller pair 12*e* is the same as that of registration roller pair 13, and that the timing (t5) of re-accelerating pre-registration roller pair 12*e* from the constant velocity V1 is when the velocity of registration roller pair 13 becomes equal to the constant velocity V1 of the pre-registration roller pair. The time t5, however, may be slightly before or after when the velocity of registration roller pair 13 becomes equal to the constant velocity V1 of the pre-registration roller pair, provided that successful skew correction is possible without causing buckling.

In the foregoing, an example has been described in which the rate of acceleration of registration roller pair 13 is constant and the same as that of pre-registration roller pair 12*e*. The example, however, is not limiting. Further, though an example in which the rate of acceleration of pre-registration roller pair 12*e* is equal between t1 and t2 and between t5 and t6 has been described, it is not limiting. Even if there is some difference in the rate of acceleration, it is possible to appropriately execute skew correction of recording paper and to prevent buckling, by adjusting time t4, t5 or t6.

Though an example of feeding a sheet of recording paper has been described above, it is not limiting. Similar to the first embodiment, the second embodiment is also applicable to automatic document feeder 120 for feeding a document to a scanning position. This will be specifically described in the following. Automatic document feeder 120 and image reading device 90 are the same as those described above with reference to FIG. 10 and, therefore, accumulative description will not be repeated.

When the front surface of a document is to be read, a process similar to the process of steps 600 to 632 may be executed, in which registration roller pair 85 serves as registration roller pair 13 for feeding the sheet of recording paper and pick-up roller 55 serves as pre-registration roller pair 12*e*. When the back surface of the document is to be read, the process similar to the process of steps 600 to 632 may be executed, in which registration roller pair 85 serves as registration roller pair 13 for feeding the sheet of recording paper and discharge roller pair 58 for reverse rotation serves as pre-registration roller pair 12*e*. By such an approach, no matter whether the front surface or back surface of the document is to be read, the document can be passed between document reading glass 84 and reading guide plate 86 with the skew corrected. Here, the constant velocity of the pre-registration roller pair (pick-up roller 55 or reverse-rotated paper discharge roller pair 58) should be close to the process velocity of document scanning or a velocity not very much lower than the process velocity.

In place of using pick-up roller 55 as pre-registration roller pair 12*e*, a new conveyor roller pair may be provided along the document feeding path between pick-up roller 55 and registration roller pair 85 (for example, at a position closer to registration roller pair 85 than pick-up roller 55), and the process similar to the process of steps 600 to 632 may be executed using the new conveyor roller pair as pre-registration roller pair 12*e*. In that case, also when the back surface of the document is read, similar to the process of steps 600 to 632 may be executed, using the new conveyor roller pair as pre-registration roller pair 12*e*.

In the foregoing, an example in which the amount of deflection of the sheet of recording paper is adjusted by CPU 200 in accordance with the elapsed time has been described. The example above, however, is not limiting. By way of example, CPU 200 may adjust the amount of deflection of the sheet of recording paper by determining whether or not a prescribed number of pulses has been transmitted to registration roller driving motor 212 or to conveyor roller driving motor 214. CPU 200 may obtain the number of pulses transmitted to registration roller driving motor 212 and to conveyor roller driving motor 214 from, for example, motor driver 210.

Further, as shown in FIG. 14, if the rotations of registration roller pair 13 and pre-registration roller pair 12*e* are controlled, the sequence of pulse signals for appropriately deflecting the sheet of recording paper to correct any skew can be specified in accordance with the characteristics of recording paper conveying mechanism of image forming apparatus 100. Specifically, in accordance with the process velocity Vc of registration roller pair 13 and pre-registration roller pair 12*e*, the constant velocity V1 (V1<Vc) of pre-registration roller pair 12*e*, and control characteristics of registration roller driving motor 212 and conveyor roller driving motor 214, the time periods of t1 to t3, t3 to t4, t4 to t5 and t5 to t6 may be determined appropriately. If the determined pulse sequence is used, it is unnecessary to determine the elapsed time, or the number of pulses transmitted to the motors. By way of example, if it is detected by sensor 160 that the leading edge of the sheet of recording paper reached pre-registration roller pair 12*e*, what is necessary is simply to transmit a prescribed signal from CPU 200 to motor driver 210. Thereafter, motor driver 210 have only to read the pulse signals of a prescribed sequence (a pulse sequence that forms the overall velocity waveforms as shown in FIG. 14) from ROM 202 and output the same to registration roller driving motor 212 and conveyor roller driving motor 214.

If CPU 200 controls motor driver 210 by determining the elapsed time or the number of pulses transmitted to the motor, what can be controlled by CPU 200 is the timing of transmitting the control signals. Therefore, the velocity waveforms of the roller are determined at time points t1, t3, t4, t5 and t6 (see FIG. 14) when CPU 200 transmits the control signals to motor driver 210. If the pulse sequences of overall waveforms such as shown in FIG. 14 are determined in advance, the object of control is only the first time point t1, and the following pulse sequences are all determined.

Since the timing at which feeding of the sheet of recording paper is completed is substantially constant, pulse sequences including the timing of stopping registration roller pair 13 and pre-registration roller pair 12*e* can also be determined. If such pulse sequences are used, provision of a sensor for detecting the trailing edge of the sheet of recording paper on the downstream side of registration roller pair 13 becomes unnecessary.

In the foregoing, an example in which motors for driving registration roller pair 13 and pre-registration roller pair 12*e* are provided respectively has been described. This example, however, is not limiting. By way of example, using electromagnetic clutches, registration roller pair 13 and pre-registration roller pair 12*e* may be driven by one motor. Specifically, a first electromagnetic clutch for transmitting motor rotation to registration roller pair 13 and a second electromagnetic clutch for transmitting motor rotation to pre-registration roller pair 12*e* may be provided, and control signals are supplied from the CPU 200 to the first and second electromagnetic clutches, to connect or open the first and second electromagnetic clutches. By such an approach, rotations of registration roller pair 13 and pre-registration roller pair 12*e* can be controlled as shown in FIG. 14.

In the foregoing, an example of step 600 has been described in which rotation of pre-registration roller pair 12*e* is started when a sheet of recording paper is detected by sensor 160 and when the leading edge of the sheet reaches near registration roller pair 13, rotation of pre-registration roller pair 12*e* is temporarily suspended. The example, however, is not limiting. Even when the leading edge of the sheet reaches near registration roller pair 13, rotation of pre-registration roller pair 12*e* may not be suspended, and the leading edge of the sheet of recording paper may abut registration roller pair 13. In that case, hitting sound (collision noise) generates when the leading edge of the sheet abuts registration roller pair 13. However, it is possible to feed the sheets of recording paper faster and, hence, continuous image formation can be done at high speed.

The embodiments as have been described here are mere examples and should not be interpreted as restrictive. The scope of the present invention is determined by each of the claims with appropriate consideration of the written description of the embodiments and embraces modifications within the meaning of, and equivalent to, the languages in the claims.

What is claimed is:

1. A recording paper conveying device, comprising:

a registration roller pair;

a conveyor roller pair arranged adjacent to the registration roller pair on an upstream side of a recording paper feeding direction;

a driving device that causes the registration roller pair and the conveyor roller pair to rotate; and a control unit that controls the driving device such that it:

causes the conveyor roller pair to rotate and convey a sheet of recording paper while the registration roller pair are stationary until a leading edge of said sheet of recording paper abuts said registration roller pair and deflects by a prescribed amount, causes said registration roller pair to rotate with said conveyor roller pair kept rotating such that said sheet of recording paper is kept deflected, so as to start feeding of said sheet of recording paper by said registration roller pair, and causes said registration roller pair to keep rotating while rotation of said conveyor roller pair is either suspended for a prescribed time period longer than zero seconds and thereafter restarted, or is decelerated for a prescribed time period longer than zero seconds and thereafter accelerated, wherein the control unit controls the driving device such that rotation of said conveyor roller pair is suspended or decelerated while said registration roller pair is rotating with acceleration.

2. The recording paper conveying device according to claim 1, wherein the control unit controls the driving device such that while said registration roller pair is rotating, rotation of said conveyor roller pair is suspended for said prescribed time period and thereafter restarted to resume a state of rotation that existed before the suspension occurred, or decelerated for said prescribed time period and thereafter accelerated to resume a state of rotation that existed before the deceleration occurred.

3. The recording paper conveying device according to claim 2, wherein the control unit controls the driving device such that:

a velocity of rotation of said conveyor roller pair when said registration roller pair is rotated with said sheet of recording paper kept deflected is a constant velocity;

the state of rotation of the conveyor roller pair that existed before the suspension occurred or that existed before deceleration occurred was rotation at said constant velocity; and said registration roller pair are rotated in an accelerating matter with said sheet of recording paper kept deflected until a velocity of rotation of the registration roller pair attains said constant velocity.

4. The recording paper conveying device according to claim 1, wherein the driving device comprises:

a first driving device for rotating said registration roller pair; and a second driving device different from said first driving device, for rotating said conveyor roller pair.

5. The recording paper conveying device according to claim 4, wherein said first and second driving devices are stepping motors;

said control unit comprises a motor driver that supplies pulse signals of a prescribed sequence for controlling the stepping motors of each of said first and second driving devices; and wherein said motor driver supplies, to said second driving device, pulse signals of a sequence causing rotation of said second driving device to be suspended for a prescribed time period longer than zero seconds and thereafter restarted, or to be decelerated for a prescribed time period longer than zero seconds and thereafter accelerated, while supplying, to said first driving device, pulse signals of a sequence causing said first driving device to rotate.

6. An image forming apparatus comprising the recording paper conveying device according to claim 1.

7. A document feeding device, comprising:

a registration roller pair;

a conveyor roller arranged adjacent to the registration roller pair on an upstream side of a document feeding direction;

a driving device that causes the registration roller pair and the conveyor roller to rotate: and a control unit that controls the driving device such that it:

causes the conveyor roller to rotate and convey a document while the registration roller pair are stationary until a leading edge of said document abuts said registration roller pair and deflects by a prescribed amount, causes said registration roller pair to rotate with said conveyor roller kept rotating such that said document is kept deflected, so as to start feeding of said document by said registration roller pair, and causes said registration roller pair to keep rotating while rotation of said conveyor roller is either suspended for a prescribed time period longer than zero seconds and thereafter restarted, or is decelerated for a prescribed time period longer than zero seconds and thereafter accelerated, wherein the control unit controls the driving device such that rotation of said conveyor roller is suspended or decelerated while said registration roller pair is rotating with acceleration.

8. A recording paper conveying device, comprising:

a registration roller pair;

a conveyor roller pair arranged adjacent to the registration roller pair on an upstream side of a recording paper feeding direction;

a driving device that causes the registration roller pair and the conveyor roller pair to rotate; and a control unit that controls the driving device such that it:

causes the conveying roller pair to rotate and convey a sheet of recording paper while the registration roller pair are stationary until a leading edge of said sheet of recording paper abuts said registration roller pair and deflects by a prescribed amount, causes said conveyor roller pair to rotate at a constant velocity to cause said deflection of said sheet of recording paper, causes said registration roller pair to rotate to start feeding of said sheet of recording paper by said registration roller pair, with said sheet of recording paper kept deflected and said conveyor roller pair kept rotating at said constant velocity; and causes the rotation of the conveyor roller pair to be further positively accelerated from said constant velocity when a velocity of rotation of said registration roller pair reaches a prescribed velocity, wherein the control unit controls the driving device such that from when feeding of said recording paper by said registration roller pair is started until rotation of said conveyor roller pair is further positively accelerated from said constant speed, said conveyor roller pair is rotated at said constant speed.

9. The recording paper conveying device according to claim 8, wherein the control unit causes the driving device to:

cause said conveyor roller pair to rotate while the registration roller pair are stationary to feed said sheet of recording paper until a leading edge of said sheet of recording paper reaches a position near said registration roller pair and then causes said conveyor roller pair to stop rotation; and thereafter causes said conveyor roller pair to rotate with acceleration to cause said deflection of said sheet of recording paper.

10. The recording paper conveying device according to claim 8, wherein after the driving device causes the registration roller pair to begin rotating to start feeding of said sheet of recording paper by said registration roller pair, the driving device causes rotation of said registration roller pair to accelerate.

11. The recording paper conveying device according to claim 10, wherein the control unit controls the driving device such that it:

causes said conveyor roller pair to accelerate from a stationary state at a constant rate of acceleration and to thereafter rotate at said constant velocity, and causes the conveyor roller pair to accelerate at a constant rate of acceleration from said constant velocity at the same constant rate of acceleration that said registration roller pair are caused to accelerate.

12. The recording paper conveying device according to claim 10, wherein the driving device causes further accelerating rotation of said conveyor roller pair from said constant velocity when a velocity of rotation of said registration roller pair becomes equal to said constant velocity.

13. The recording paper conveying device according to claim 8, wherein the driving device comprises:

a first driving device for rotating said registration roller pair; and a second driving device different from said first driving device, for rotating said conveyor roller pair.

14. The recording paper conveying device according to claim 13, wherein said first and second driving devices are stepping motors; and said control unit comprises a motor driver that supplies pulse signals of a prescribed sequence for controlling the stepping motors of each of said first and second driving devices; and wherein:

said motor driver supplies pulse signals of a first sequence to cause said conveyor roller pair to rotate at said constant velocity to said second driving device to cause said deflection of said recording paper, said motor driver supplies pulse signals of a second sequence to cause said registration roller pair to rotate to said first driving device, while the pulse signals of said first sequence are supplied to said second driving device, and when a velocity of rotation of said registration roller pair reaches a prescribed velocity, said motor driver supplies pulse signals of a third sequence to further accelerate rotation of said conveyor roller pair from said constant velocity, to said second driving device.

15. An image forming apparatus comprising the recording paper conveying device according to claim 8.

16. A document feeding device, comprising:

a registration roller pair;

a conveyor roller arranged adjacent to the registration roller pair on an upstream side of a document feeding direction;

a driving device that causes the registration roller pair and the conveyor roller to rotate; and a control unit that controls the driving device such that it:

causes the conveyor roller to rotate and feed a document while the registration roller pair are stationary until a leading edge of said document abuts said registration roller pair and deflects by a prescribed amount, causes said conveyor roller to rotate at a constant velocity to cause said deflection of said document;

causes said registration roller pair to rotate to start feeding of said document by said registration roller pair, with said document kept deflected and said conveyor roller kept rotating at said constant velocity; and causes rotation of the conveyor roller to positively accelerate from said constant velocity when a velocity of rotation of said registration roller pair reaches a prescribed velocity, wherein the control unit controls the driving device such that from when feeding of said document by said registration roller pair is started until rotation of said conveyor roller is further positively accelerated from said constant speed, said conveyor roller is rotated at said constant speed.

* * * * *